US005680164A

United States Patent [19]

Miller et al.

[11] Patent Number: 5,680,164

[45] Date of Patent: Oct. 21, 1997

[54] REFILL METHOD AND APPARATUS FOR INK CARTRIDGE UNITS

[75] Inventors: Dana D. Miller; John Dion; Rubén Oscar Peña Ortíz, all of Corvallis, Oreg.

[73] Assignee: Hewlett-Packard Company, Palo Alto, Calif.

[21] Appl. No.: 346,561

[22] Filed: Nov. 29, 1994

[51] Int. Cl.[6] ..... B41J 2/175

[52] U.S. Cl. ..... 347/87

[58] Field of Search ..... 347/36, 85–87

[56] References Cited

U.S. PATENT DOCUMENTS

| | | | |
|---|---|---|---|
| 4,217,058 | 8/1980 | Straszewski et al. | 401/135 |
| 4,306,245 | 12/1981 | Kasugayama et al. . | |
| 4,329,698 | 5/1982 | Smith . | |
| 4,368,478 | 1/1983 | Kote . | |
| 4,412,232 | 10/1983 | Weber et al. . | |
| 4,419,678 | 12/1983 | Kasugayama et al. . | |
| 4,500,895 | 2/1985 | Buck et al. . | |
| 4,511,678 | 4/1985 | Mahnke et al. . | |
| 4,749,291 | 6/1988 | Kobayashi et al. . | |
| 4,771,295 | 9/1988 | Baker et al. . | |
| 4,794,409 | 12/1988 | Cowger et al. . | |
| 4,929,969 | 5/1990 | Morris . | |
| 4,931,811 | 6/1990 | Cowger et al. . | |
| 4,963,189 | 10/1990 | Hindagolla | 106/22 |
| 4,998,115 | 3/1991 | Nevarez et al. | 347/66 |
| 5,153,612 | 10/1992 | Dunn et al. . | |
| 5,199,470 | 4/1993 | Goldman | 141/1 |
| 5,329,294 | 7/1994 | Ontawar et al. . | |

FOREIGN PATENT DOCUMENTS

| | | | |
|---|---|---|---|
| 0 139 508 | 5/1985 | European Pat. Off. . | |
| 0 408 241 | 1/1991 | European Pat. Off. . | |
| 5-162330 | 6/1993 | Japan | 347/86 |
| 2 269 784 | 2/1994 | United Kingdom | 347/86 |

OTHER PUBLICATIONS

IBM Technical Disclosure Bulletin, (vol. 34, No. 1), pp. 459–462 Jun. 1991.

Information sheet entitled, "Pelikan Hardcopy", The Pelikan Company.

*Hewlett–Packard Journal,* vol. 36, No. 5 (May 1985).

*IBM Technical Disclosure Bulletin,* (vol. 34, No. 1, Jun. 1991), pp. 459–462.

*Primary Examiner*—Benjamin R. Fuller

*Assistant Examiner*—Judy Nguyen

[57] ABSTRACT

A refill system for ink cartridges. A refill unit is provided which includes a housing having a foam portion impregnated with ink. The foam portion includes a lower section extending outwardly from a lower panel. Positioned within the panel is an annular channel surrounding the lower section. The refill unit is positioned within an empty ink cartridge modified to include an annular seal member therein. The refill unit is inserted so that the channel receives the seal member. Upon insertion of the refill unit, the lower section of the foam member is engaged against an ink filter within the cartridge. Alternatively, the refill unit may include an enlarged lower section associated with the foam portion, with the annular channel being absent. This unit is used in cartridges which do not have the seal member. The enlarged lower section firmly engages the entire ink filter within the cartridge.

13 Claims, 6 Drawing Sheets

REFILL METHOD AND APPARATUS FOR INK CARTRIDGE UNITS

BACKGROUND OF THE INVENTION

The present invention generally relates to automated printing systems, and more particularly to an ink refill system for ink cartridge units which is characterized by a high degree of efficiency and utility.

Substantial developments have been made in the field of electronic printing technology. Specifically, a wide variety of highly efficient printing systems currently exist which are capable of dispensing ink in a rapid and accurate manner. Thermal inkier systems are especially popular in this regard. Thermal inkjet printing systems basically include an ink reservoir in fluid communication with a substrate having a plurality of resistors thereon. Selective activation of the resistors causes thermal excitation of the ink and expulsion thereof from the ink cartridge. Representative thermal inkier systems and sic inkjet technology are discussed in U.S. Pat. No. 4,500,895 to Buck et al.; U.S. Pat. No. 4,794,409 to Cowget et al.; and the *Hewlett-Packard Journal,* Vol. 36, No. 5 (May 1985), all of which are incorporated herein by reference.

The functional components of a typical thermal inkjet printhead (including the resistor structures and elements associated therewith) are capable of operating over a substantial period of time without a significant deterioration in print quality. Since thermal inkier print cartridges are normally characterized by the absence of moving parts, problems associated with internal component wear do not normally result. Accordingly, when a typical thermal inkjet cartridge has depleted its internal ink supply, the printhead components associated therewith nonetheless remain in working order. However, conventional practice has involved the disposal of thermal inkier cartridges after ink depletion, notwithstanding the operational capabilities of the printheads associated with these cartridges. This practice offers particular disadvantages including increased consumer costs, as well as the production of additional waste materials (empty cartridges).

The present invention involves a unique and highly-efficient system for refilling empty ink cartridges including thermal inkjet cartridge units. The system described herein is characterized by numerous benefits including but not limited to (1) the conservation of materials and a corresponding reduction in the generation of waste products; and (2) increased consumer economy resulting from the reuse of key components associated with empty cartridge units. Furthermore, the system of the present invention is readily implemented using a minimal amount of time and materials. For these reasons, the invention represents an advance in the art of ink printing technology as discussed in further detail below.

SUMMARY OF THE INVENTION

It is an object of the present invention to provide a system for refilling empty ink cartridge units.

It is another object of the invention to provide a system for refilling empty ink cartridge units wherein the refill process is undertaken in a rapid manner.

It is another object of the invention to provide a system for refilling empty ink cartridge units wherein refilling is accomplished in a highly-efficient manner without the significant spillage of ink materials during the refill process.

It is a further object of the invention to provide a system for refilling empty ink cartridge units wherein the refill process involves a separate, self-contained refill unit which is readily inserted within an empty cartridge unit in a rapid and substantially leak-free manner.

It is a still further object of the invention to provide a system for refilling empty ink cartridge units wherein the refill process involves the use of a separate, self-contained refill unit that is structurally designed for precise engagement and fluid communication with the cartridge unit in a manner which enables uninterrupted ink flow from the refill unit to the cartridge unit printhead.

It is an even further object of the invention to provide a system for refilling empty ink cartridge units which is beneficial from an environmental and conservation perspective.

In accordance with the present invention, a highly efficient and economical system for refilling empty ink cartridge units is provided. While the invention shall be described with primary reference to thermal inkjet technology, it is likewise applicable to ink cartridge units which employ other ink ejection systems as discussed below. Thermal inkjet cartridge units basically comprise a containment vessel having a top portion, a bottom portion, and a retaining wall portion between the top portion and bottom portion to form a substantially closed structure. The containment vessel further includes an internal chamber therein which is surrounded by the retaining wall portion. The internal chamber is designed to retain a supply of ink therein. The ink may reside in uncontained form within the internal chamber, may be positioned within a bladder-like structure, or can be stored within an absorbent foam member which is saturated with ink. Alternatively, the internal chamber may include a spring-bag mechanism which provides a negative pressure (suction) that facilitates the proper delivery of ink materials from the chamber. Likewise, the inkier cartridge will typically include a cap member secured to the top portion which is removed. As a result, the thermal inkier cartridge unit will include an open top portion which provides access to components within the cartridge unit. Prior to refilling in accordance with the present invention, any ink-retaining structures (e.g. foam members, bladders, or spring-bag mechanisms) are then removed from the internal chamber.

In a preferred embodiment of the invention, the retaining wall portion of the cartridge unit comprises an inner surface, with the inner surface including a plurality of notches therein. The functional capabilities of these notches will be discussed below. The bottom portion of the cartridge unit further includes a printhead which comprises a plurality of resistors thereon and an outer plate having at least one outlet passing entirely through the plate for each resistor. In addition, a standpipe or tubular conduit is positioned within the cartridge unit between the printhead and the internal chamber. The conduit includes an upper end and a lower end, with the lower end being positioned adjacent to and in fluid communication with the printhead. The upper end of the conduit is positioned adjacent to and in fluid communication with the internal chamber within the containment vessel. An ink filter member (e.g. a portion of screen or mesh material) is secured to and covers the upper end of the conduit in order to filter ink materials which pass through the system so that foreign contaminants may be removed. Finally, in a preferred embodiment of the invention, an annular seal member is fixedly secured to the filter member and positioned directly over (in axial alignment with) the upper end of the conduit. The functional capabilities of the seal member will be described below.

In accordance with the invention, a closed, self-contained refill unit is provided which is positioned within the containment vessel of the empty inkier cartridge unit. The refill unit basically includes a housing which comprises an upper portion, a lower portion, and a side wall portion having an outer surface, with the side wall portion being positioned between the upper portion and the lower portion. Also included is an internal cavity within the housing which is surrounded by the side wall portion. The lower portion of the housing comprises a lower panel member which includes at least one opening therethrough in order to provide access to the internal cavity within the housing. In a preferred embodiment, the lower panel member further includes an exterior surface and a continuous, inwardly extending annular channel positioned within the exterior surface of the lower panel member. The annular channel is configured so that it entirely surrounds the opening through the lower panel member.

Positioned within the internal cavity of the housing is a fluid absorbent member (e.g. constructed from foam or other fibrous/reticulated composition). The fluid absorbent member further comprises a lower section (optimally circular in cross-section) extending outwardly from the opening within the lower panel member and beyond the exterior surface of the panel member. The outwardly-extending character of the lower section ensures precise, tight, and intimate engagement between the lower section of the fluid absorbent member and the operative components of the cartridge unit (e.g. the ink filter member and annular seal member). Finally, the fluid absorbent member includes a supply of a selected ink retained (absorbed) therein.

The refill unit likewise includes additional features of importance. In a preferred embodiment, the side wall portion of the housing will include at least one port therethrough to provide access to the fluid absorbent member within the housing. An elongate pressure-exerting member is thereafter provided which is movably positioned within the port. The pressure-exerting member comprises an inner end, an outer end, and an elongate bore passing continuously through the pressure-exerting member from the outer end to the inner end. The bore functions as an air flow control system in order to maintain proper pressure levels within the refill unit as discussed below. The inner end is located within the internal cavity of the housing adjacent the fluid absorbent member, with the outer end being located outside of the housing. Movement of the pressure-exerting member inwardly by applying pressure against the outer end causes the inner end thereof to press against the fluid absorbent member within the internal cavity of the housing. In this regard, the refill unit and fluid absorbent member therein may be "primed" for ink delivery to the cartridge unit as described in further detail below.

Additional features of the refill unit include a plurality of outwardly-extending tab members fixedly secured to the outer surface of the side wall portion. The tab members are designed for engagement within the notches in the inner surface of the retaining wall portion of the cartridge unit. In this manner, the refill unit may be securely positioned within the internal chamber of the cartridge unit. Likewise, the refill unit may further comprise a plurality of individual bores beginning at the exterior surface of the lower panel member and extending partially therethrough, with the bores being positioned adjacent the annular channel in the panel member. As discussed below, the bores are designed to receive any dowels, pins, or comparable structures therein which extend upwardly within the cartridge unit from components associated with the printhead. Finally, the lower panel member may further include at least one recessed portion therein which is positioned rearwardly from the lower section of the foam member. The recessed portion begins at the exterior surface of the lower panel member and extends inwardly but not entirely through the panel member. In many cases, the cartridge unit to be refilled will include one or more upwardly-extending components within the bottom portion thereof (e.g. bubble generator elements and the like). The recessed portion is designed to receive these components when the refill unit is mounted in position.

To refill an empty inkjet cartridge of the type described above, the refill unit is positioned through the open top portion of the containment vessel and inserted within the internal chamber of the cartridge unit. Thereafter, the refill unit is urged downwardly within the internal chamber of the cartridge unit until the annular seal member of the cartridge is positioned within the annular channel of the refill unit. As a result, the refill unit is properly aligned within the cartridge unit and a fluid-tight seal is created between the refill and cartridge units. Furthermore, in this orientation, the lower section of the fluid absorbent member against is placed in contact with and against the filter member, and is surrounded by said annular seal member. Secure and intimate engagement between the lower section of the fluid absorbent member and the ink filter member is ensured by the outwardly-extending character of the lower section.

The refill unit is maintained in position using the tab members described above. Specifically, each of the tab members on the refill unit is engaged/positioned within one of the notches inside the cartridge unit as the refill unit is urged downwardly into the cartridge Unit. Engagement of the tabs within the notches enables the refill unit to be fixedly secured in position with the lower section of the fluid absorbent member firmly positioned against the ink filter member. Removal of the refill unit after ink depletion is accomplished by reversing the foregoing steps.

In an alternative embodiment of the invention, the foregoing cartridge and refill units are structurally modified as described herein. Specifically, the cartridge unit will include the same features listed above except for the annular seal member which is not used in this embodiment. To accommodate this design modification, the refill unit is correspondingly altered to eliminate the annular channel from the lower panel member. Furthermore, the opening in the lower panel member is preferably enlarged, with the outwardly-extending lower section of the absorbent member (preferably circular in cross-section in this embodiment) also being of greater size (e.g. larger diameter) compared with the initial embodiment. It should also be noted that cartridge unit in this embodiment will not include any pins or dowels which were removed prior to refilling or were never present initially. In this regard, the refill unit will not include any bores within the lower panel member. Other features of the cartridge and refill units in this embodiment are the same as those listed above, including the use of an elongate pressure-exerting member in the refill unit to prime the system, the recessed portion in the refill unit, as well as the tab/notch arrangement previously discussed.

To refill an empty inkier cartridge in accordance with the alternative embodiment described above, the refill unit is again positioned through the open top portion of the containment vessel and inserted within the internal chamber of the cartridge unit. Thereafter, the refill unit is urged downwardly within the internal chamber of the cartridge unit until the outwardly-extending lower section of the fluid absorbent member is firmly positioned against and engaged with the ink filter member in the cartridge. Secure and intimate engagement between the lower section of the fluid absorbent member and the ink filter member is ensured by the outwardly-extending character of the lower section as previously discussed. This orientation of components is maintained by positioning each of the tab members on the refill unit within one of the notches inside the cartridge unit as the refill unit is being urged downwardly into the cartridge unit. Engagement of the tabs within the notches enables the refill unit to be fixedly secured in position with the lower section of the fluid absorbent member firmly placed against the ink filter member. Removal of the refill unit after ink depletion is again accomplished by reversing the foregoing steps.

A still further embodiment of the invention is provided which is useful in connection with the inkier cartridge unit described above which includes at least one and preferably two catch basins/ink drainage compartments positioned within the bottom portion of the cartridge unit. The ink drainage compartments are positioned adjacent the tubular conduit which connects the printhead components with the internal chamber. They are function to retain extraneous or residual ink which may collect within the bottom portion of the cartridge unit during printer operation. It should also be noted that the cartridge unit in this embodiment of the invention likewise does not include the annular seal member therein or any dowels, pins, and the like which were removed prior to refilling or were never present initially.

The refill unit in this embodiment is of the same general type previously described in the second embodiment of the invention with one particular exception. Specifically, the downwardly-extending lower section of the fluid absorbent member (which is preferably rectangular in cross-section in this embodiment) is of even greater size (length) compared with the previous two embodiments. Specifically, the lower section of the fluid absorbent member is of significantly increased length and is characterized by the presence of at least one outwardly-extending end portion which is sufficiently long to extend beyond the ink filter member within the cartridge unit when the refill unit is mounted therein. In a preferred embodiment, an outwardly-extending end portion will be employed at each end of the lower section of the fluid absorbent member. Other features of the cartridge and refill units in this embodiment are the same as those listed above in the primary and secondary embodiments, including the use of a pressure-exerting member in the refill unit to prime the fluid absorbent member, a recessed portion in the refill unit, as well as the tab/notch system previously discussed.

To refill an empty inkjet cartridge in accordance with the present embodiment, the refill unit is again positioned through the open top portion of the containment vessel and inserted within the internal chamber of the cartridge unit. Thereafter, the refill unit is urged downwardly within the internal chamber of the cartridge unit until the outwardly-extending lower section of the fluid absorbent member is firmly positioned against and engaged with the ink filter member in the cartridge. Secure engagement between the lower section of the fluid absorbent member and the ink filter member is ensured by the downwardly-extending character of the lower section as described above. This arrangement of components is maintained by positioning each of the tab members on the refill unit within one of the notches in the cartridge unit as the refill unit is being urged downwardly into the cartridge unit. Engagement of the tab members within the notches effectively secures the refill unit in position with the lower section of the fluid absorbent member firmly positioned against the ink filter member. Furthermore, as the lower section of the fluid absorbent member is securely engaged against the ink filter member, each outwardly-extending end portion associated with the lower section of the absorbent member will be positioned directly over and partially within one of the ink drainage compartments in the bottom portion of the cartridge unit. When the ink drainage compartments become substantially filled with ink, the ink will come in contact with the end portions of the lower section and be drawn therein for subsequent delivery to the printhead. In this manner, residual ink materials which normally remain unused are made available during printer operation. Removal of the refill unit after ink depletion is accomplished by reversing the foregoing steps.

As discussed below, the present invention provides numerous benefits including but not limited to improved economy of operation and a corresponding reduction in the generation of waste materials. Likewise, the invention may be used in connection with many different cartridge units, ink materials, and printing systems. In this regard, the invention shall not limited exclusively to any particular cartridge systems, ink compositions, or printer units. These and other objects, features, and benefits of the present invention shall be described below in the following Brief Description of the Drawings and Detailed Description of Preferred Embodiments.

DETAILED DESCRIPTION OF PREFERRED EMBODIMENTS

As indicated above, the present invention involves a unique and highly efficient refill system and method for inkier cartridge units. While the invention shall be described herein with primary reference to thermal inkier technology, it is likewise applicable to ink cartridge units which employ other ink ejection systems as discussed below. Normally, the components associated with inkier printheads (especially thermal inkier units) remain in an operable state after the initial supplies of ink within the unit have been depleted. The present invention recognizes this fact and provides a refill system which is positioned in an empty cartridge unit so that it may be reused. Refilling of the cartridge unit in accordance with the invention is undertaken an efficient and economical manner. In this regard, the present invention represents an advance in the art of inkier printing technology.

Figure 1:
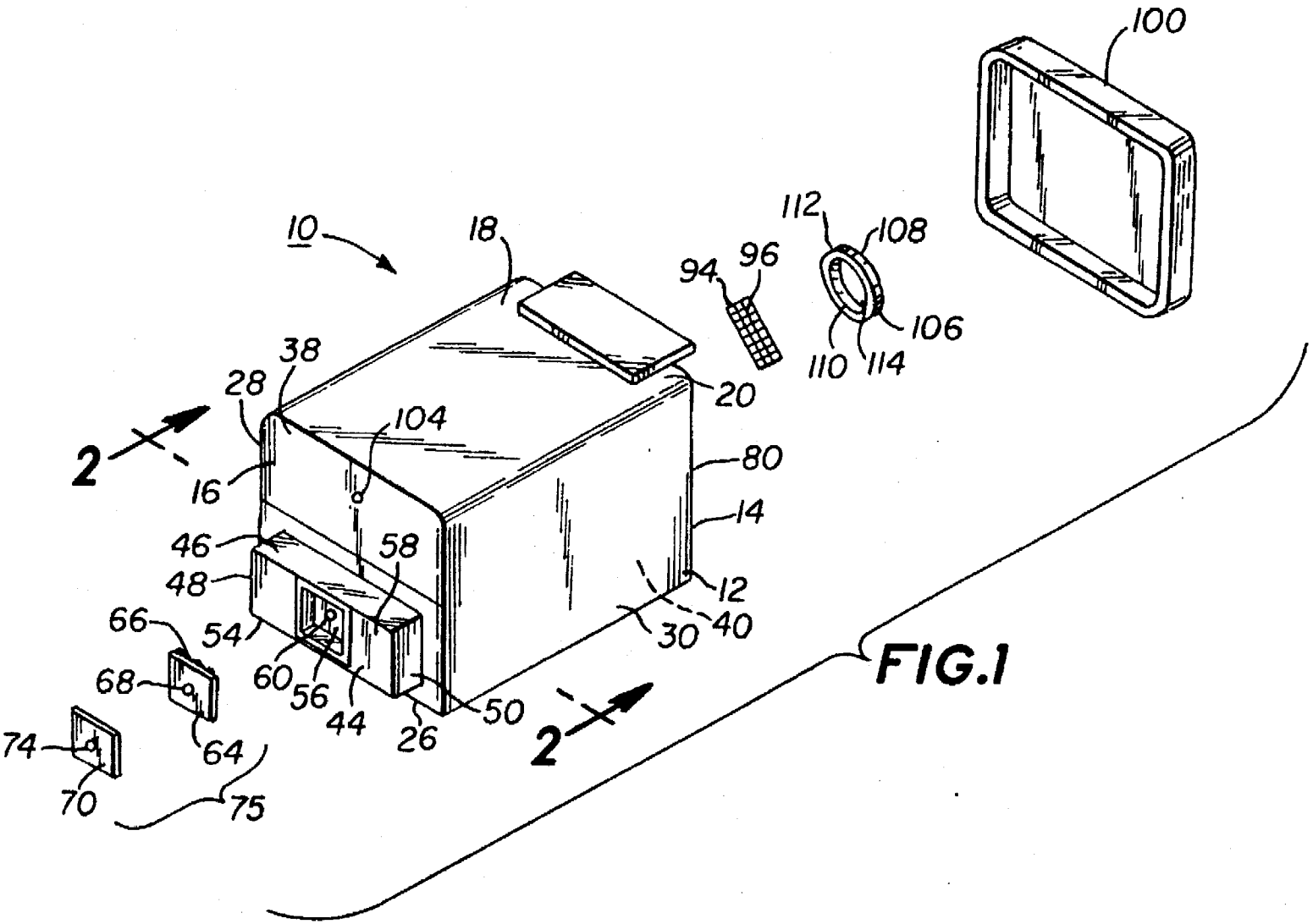
FIG. 1 is a bottom, partially exploded perspective view of an exemplary thermal inkjet cartridge unit suitable for use with the present invention.

With reference to FIG. 1, an exemplary thermal ink cartridge unit 10 which is suitable for use in the present invention is schematically illustrated. This cartridge is of the same general type illustrated and described in U.S. Pat. No. 4,794,409 to Cowger et al.; U.S. Pat. No. 4,771,295 to Baker et al.; and the *Hewlett-Packard Journal*, Vol. 36, No. 5 (May 1985), all of which are incorporated hereinby reference. Furthermore, exemplary thermal inkjet cartridge units suitable for use with the present invention are commercially available from the Hewlett-Packard Company of Palo Alto, Calif. (USA) [part nos. 51626A, 51608A, 51639A, 51639C, 51639M, 51639Y, 51633A, and 51629A]. However, as previously noted, the present invention shall not be limited exclusively to any particular thermal inkier printing system, with the cartridge unit of FIG. 1 being presented for example purposes.

As illustrated in FIG. 1, the cartridge unit 10 consists of a housing in the form of a containment vessel 12 which is preferably of unitary (e.g. single-piece) construction and manufactured from a plastic which is strong, inert, and resilient. The term "resilient" as used herein shall signify a semi-rigid composition which is capable of temporary deformation upon the application of pressure thereto, followed by a return to its original configuration when the application of pressure is discontinued. Exemplary plastic materials suitable for producing the containment vessel 12 include but are not limited to high density polyethylene, polystyrene, polysulfone, and polyethyleneterephthalate. The containment vessel 12 further includes an open top portion 14, a bottom portion 16, and a retaining wall portion 18 between the top portion 14 and bottom portion 16. The retaining wall portion 18 is continuous (e.g. uninterrupted) in nature and may be substantially rectangular in cross-section. Alternatively, the cross-sectional configuration of the retaining wall portion 18 may be circular or square, with the present invention not being limited to any particular shape in connection with the retaining wall portion 18 and containment vessel 12.

Figure 2:
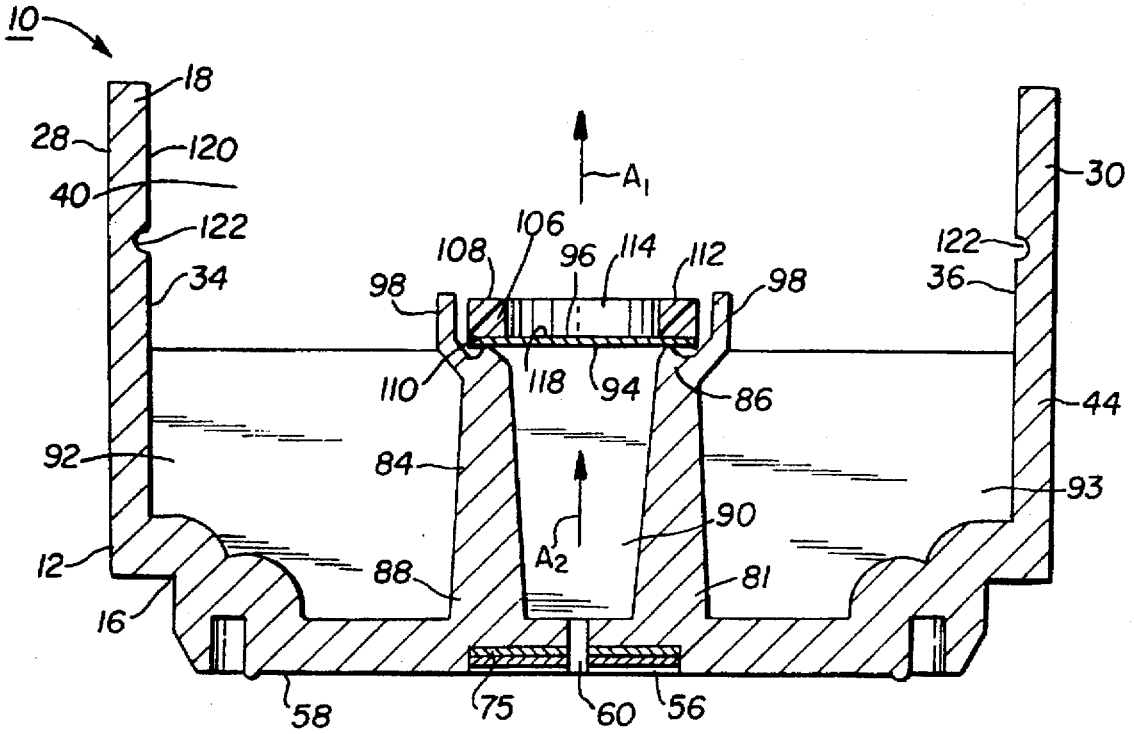
FIG. 2 is an enlarged partial cross-sectional view taken along line 2—2 of the containment vessel associated with the cartridge unit of FIG. 1 illustrating the printhead and associated components therein.

With continued reference to FIG. 1, the retaining wall portion 18 includes a top wall 20, a bottom wall 26, a first side wall 28, and a second side wall 30. With reference to FIG. 2 (discussed in further detail below), the first side wall 28 has a planar interior surface 34, with the second side wall 30 having a planar interior surface 36. The bottom portion 16 of the containment vessel 12 further includes a front wall 38 as illustrated. Surrounded by the front wall 38, top wall 20, bottom wall 26, first side wall 28, and second side wall 30 is an internal chamber 40 within the containment vessel 12, the function of which will be described below.

Extending downwardly (e.g. outwardly) from the front wall 38 as part of the bottom portion 16 of cartridge unit 10 is an outwardly-extending printhead support structure 44. The support structure 44 is also illustrated cross-sectionally in FIG. 2. Specifically, the support structure 44 includes a plurality of side sections 46, 48, 50, 54 with a recessed, substantially rectangular center zone 56 at the front 58 of the support structure 44. Positioned within the center zone 56 and passing entirely through the front 58 of the support structure 44 is an ink outlet port 60 which is in fluid communication with the internal chamber 40 of the containment vessel 12 as discussed below.

Fixedly secured to the front 58 of the support structure 44 within the center zone 56 (e.g. preferably using an adhesive composition known in the art) is a substrate in the form of a plate member 64 having a plurality of thin film resistors 66 thereon which are schematically illustrated and enlarged for the sake of clarity in FIG. 1. Likewise, the plate member 64 further includes at least one opening 68 therethrough which substantially registers and communicates with the ink outlet port 60 in the assembled cartridge unit 10. In addition, secured to the plate member 64 by adhesive, welding, fusion, or the like is an orifice plate 70. The orifice plate 70 is preferably made of an inert metal composition (e.g. gold-plated nickel or palladium-plated nickel), and further includes an ink ejection orifice 74 therethrough. The ink ejection orifice 74 is arranged on the orifice plate 70 so that it substantially registers with the opening 68 through the plate member 64 in the assembled cartridge unit 10. For the purposes of this invention, the plate member 64, thin film resistors 66, opening 68, orifice plate 70, and ink ejection orifice 74 shall collectively be characterized as the printhead 75 of the cartridge unit 10 which is a integral part of the bottom portion 16 thereof.

As noted above, the present invention shall not be limited exclusively to the cartridge unit 10 illustrated in FIG. 1. Furthermore, while the term "printhead" as used herein will preferably involve the employment of a thermal inkier system as described above (e.g. including the plate member 64, resistors 66, and orifice plate 70), it may also encompass other ink expulsion systems aside from those involving thermal inkier technology. While the invention shall be discussed below with primary reference to a thermal inkier system, the term "printhead" shall likewise encompass alternative ink expulsion means including but not limited to piezoelectric drop systems of the general type disclosed in U.S. Pat. No. 4,329,698 to Smith, dot matrix systems of the type disclosed in U.S. Pat. No. 4,749,291 to Kobayashi et al., as well as other comparable and functionally equivalent systems designed to deliver ink from a self-contained reservoir/chamber.

In the exemplary cartridge unit 10 shown in FIG. 1, ink is designed to be freely retained therein. Alternatively, an ink retention system (not shown) may be used within the internal chamber 40 of the containment vessel 12. In a preferred embodiment, the ink retention system will consist of an absorbent, multi-cellular foam block positioned within the internal chamber 40. The foam block will include a plurality of open cells or pores which are designed to retain ink therein in accordance with known capillary phenomenon. The foam block may be constructed from a wide variety of commercially available multi-cellular materials including but not limited to (1) conventional ether-type polyurethane foam materials (e.g. obtainable from the Scott Paper Company of Philadelphia, Pa. (USA) and described in U.S. Pat. No. 4,771,295 to Baker et al.) which have a porosity of about 60–75 pores per inch; (2) reticulated cellulose as described in U.S. Pat. No. 4,794,409 to Cowger et al.; (3) polyethylene foam as set forth in U.S. Pat. No. 4,306,245 to Kasugayama et al.; and (4) melamine-formaldehyde condensate foam as described in U.S. Pat. Nos. 4,929,969 to Morris and 4,511,678 to Manhke et al. which is commercially available from BASF Aktiengesellschaft of Germany. Other multi-cellular foam materials which may be used to construct the foam block include but are not limited to ether-type polyurethane foam having a porosity of about 75–90 pores/cells per inch which is commercially available from Foamex, Inc. of Eddystone, Pa. (USA).

In alternative embodiment involving the use of a foam block as described above, the block has an external size (e.g. volume) which exceeds the interior volume of the internal chamber 40 within the containment vessel 12. As a result, the foam block is effectively compressed when positioned within the internal chamber 40, thereby prevented undesired lateral and axial movement of the block during operation of the cartridge unit 10. The foam block is positioned within the internal chamber 40 of the cartridge unit 10 by placement of the block through opening 80 in the top portion 14 of the containment vessel 12 as illustrated.

It should likewise be noted that the present invention is applicable with respect to cartridge units which include ink retention bladders or spring-bag type systems (not shown) of the type illustrated respectively in U.S. Pat. Nos. 4,500,895 to Buck et al. and 5,153,612 to Dunn et al. For example, a spring-bag assembly of the type shown in U.S. Pat. No. 5,153,612 to Dunn et al. may be suitable for inclusion within the cartridge unit 10 described above. Accordingly, the present invention shall not be limited to the use of any particular ink retention/delivery systems in the cartridge unit 10.

To permit fluid communication between the internal chamber 40 and the operating elements of the printhead 75 (e.g. the plate member 64 and resistors 66), numerous additional components are provided. With particular reference to FIG. 2, the printhead support structure 44 further includes an internally-positioned standpipe or tubular conduit 81 positioned therein. The term "tubular" as used herein shall generally signify an elongate structure having a bore or passageway therethrough surrounded by a continuous wall. As illustrated in FIG. 2, conduit 81 includes a continuous side wall portion 84, an upper end 86, a lower end 88, and an internal passageway 90 which begins at the upper end 86 and terminates at the lower end 88. In this regard, the conduit 81 is positioned between the printhead 75 and the internal chamber 40 to provide fluid communication and ink transfer therebetween. To facilitate ink transfer from the internal chamber 40 to the printhead 75, the lower end 88 of the conduit 81 is adjacent to and in fluid communication with the printhead. 75 via the ink outlet port 60 as illustrated in FIG. 2, with the upper end 86 being positioned adjacent to and in fluid communication with the internal chamber 40 within the containment vessel 12.

With reference to FIG. 2, the cartridge unit 10 in a preferred embodiment will include at least one and preferably dual catch basins/ink drainage compartments 92, 93 which are positioned within the bottom portion 16 (support structure 44) of the cartridge unit 10 on each side of the tubular conduit 81. While the cartridge unit 10 may be configured to lack the ink drainage compartments or use only a single ink drainage compartment, the use of dual compartments 92, 93 is preferred. The ink drainage compartments 92, 93 retain extraneous or residual ink which may collect within the bottom portion 16 of the cartridge unit 10 during printer operation.

To filter ink materials which pass from the internal chamber 40 into and through the passageway 90 of the conduit 81, an ink filter member 94 is provided. The filter member 94 also assists in maintaining proper back-pressure levels within the internal chamber 40 of the cartridge unit 10. In a preferred embodiment as shown in FIG. 1, the filter member 94 will consist of a planar stainless steel wire mesh portion 96 fixedly secured to and covering the upper end 86 of the conduit 81 so that the filter member 94 completely covers the passageway 90.

In a preferred embodiment, the openings within the wire mesh portion 96 will have an average diameter of about 21–25 microns which is sufficient to provide substantial filtration of air bubbles and solid particulates which may be present in the ink materials. About 165×1400 wires per inch are optimally used in the mesh portion 96 in a "double-dutch twill" weave. The filter member 94/wire mesh portion 96 may be attached to the upper end 86 of the conduit 81 through use of conventional adhesive materials applied to the filter member 94, the upper end 86 of the conduit 81, or both of these components. Exemplary adhesive materials suitable for this purpose include but are not limited to conventional epoxy resin or cyanoacrylate adhesives which are known in the art. Instead of or in addition to the use of adhesive materials for this purpose, the filter member 94/wire mesh portion 96 may be secured to the upper end 86 of the conduit 81 by compressive engagement at high temperature between a plurality (e.g. optimally three) of upwardly-extending pin-like stakes or dowels 98 shown in FIG. 2 (only two being illustrated for the sake of clarity). In particular, this method is especially suitable when wire mesh portion 96 is used as the filter member 94. To mount the wire mesh portion 96 in position, it is urged downwardly between the dowels 98, with the peripheral edges of the mesh portion 96 being positioned against the dowels 98 as illustrated in FIG. 2. In the regard, the dowels 98 serve two basic functions, namely, (1) proper alignment of the mesh portion 96 over the passageway 90 of the conduit 81; and (2) attachment of the mesh portion 96 in position on the upper end 86 of the conduit 81. As noted above, the filter member 94 shall not be exclusively limited to the use of mesh portion 96, with other conventional filter materials manufactured from plastic, composites, or fibrous materials likewise being applicable in the present case.

Finally, the cartridge unit 10 will also include numerous other standard features illustrated in FIG. 1. For example, the cartridge unit 10 will typically comprise a plug or cap member 100 which is adapted for affixation (e.g. using a conventional adhesive or thermal/ultrasonic welding) to the open top portion 14 of the containment vessel 12 in order to cover the opening 80 and retain the ink (and any ink retaining/delivery structures) within the cartridge unit 10 in an air and fluid-tight manner. The cap member 100 may be of a type illustrated in U.S. Pat. No. 4,771,295 to Baker et al.

In addition, the cartridge unit 10 (which involves a non-foam liquid ink system) will include a bubble generating system designed to direct air into the internal chamber 40 of the containment vessel 12 during ink delivery so that back pressure therein is properly controlled and not of an excessive value. Many different bubble generation systems may be used for this purpose, and the present invention shall not be limited to cartridge units with any particular bubble generator design. As schematically illustrated and enlarged in FIG. 1, an exemplary bubble generator system involves a small-diameter orifice 104 beginning at the front wall 38 of the containment vessel 12 and passing entirely therethrough to permit air flow into the internal chamber 40 of the cartridge unit 10. Orifice 104 is of a type described in U.S. Pat. No. 5,153,612 to Dunn et al. In particular, the orifice 104 is designed so that ink will not leak outwardly therefrom (based on surface tension phenomena associated with the ink materials commonly used in thermal inkier printing systems). Likewise, the orifice 104 is designed to prevent the movement of ambient air therethrough and into the internal chamber 40 unless sufficient back pressure exists within the chamber 40. To accomplish these goals, the diameter of the orifice 104 in an exemplary embodiment of the cartridge unit 10 shown in FIG. 1 is about 200 microns as discussed in the Dunn et al. patent. It should also be noted that bubble generation systems will typically not be needed in cartridge units which include ink-retaining foam members therein.

As previously indicated, many different cartridge units, bubble generation systems, inks, ink retaining systems, and the like may be used in connection with the present invention which shall not be limited in this regard. However, in accordance with a preferred embodiment of the invention, there are certain inventive modifications which are made to the selected cartridge unit (e.g. cartridge unit 10 in FIGS. 1–2) which are significant. As shown in FIGS. 1–2, an annular seal member 106 is provided which includes a upper surface 108, a lower surface 110, a main body portion 112, and a central opening 114 surrounded by the body portion 112 (FIG. 1). While a preferred embodiment of the invention involves the use of a seal member 106 having a ring-like structure which is circular in cross-section as illustrated in FIG. 1, the term "annular" as stated herein may encompass a comparable structure which is ring-like, yet non-circular in cross-section. For example, the seal member 106 may be rectangular or square in cross-section depending on a variety of production parameters and other considerations, provided that the member 106 include a central opening surrounded by a body portion. Many different construction materials may be used to produce the seal member 106, with the present invention not being limited to any particular compositions. In a preferred embodiment, the seal member 106 is manufactured from polytetrafluoroethylene (e.g. "Teflon"). Alteratively, the seal member 106 may be constructed from other materials including but not limited to polysulfone plastic, as well as high density polyethylene, polystyrene, polyethyleneterephthalate, or other applicable composite materials. While the invention shall not be limited to any particular numerical parameters regarding the seal member 106, it will preferably be circular in cross-section with a diameter of about 9.0–9.75 mm and a uniform thickness of about 1.20–1.50 mm. Likewise, the diameter of the central opening 114 within the seal member 106 will optimally be about 6.25–7.0 mm, and preferably less than the diameter of the tubular conduit 81 as discussed below.

As illustrated in the embodiment of FIG. 2, the seal member 106 is fixedly secured to the upper face 118 of the filter member 94 (e.g. mesh portion 96). In particular, the lower surface 110 of the seal member 106 is attached to the upper face 118 of the filter member 94 by the application of a selected adhesive to the seal member 106, filter member 94, or both. Many different adhesive materials may be used for this purpose, with the invention not being limited to any particular adhesive composition. Exemplary adhesive materials suitable for this purpose include standard cyanoacrylate adhesives, 2-part epoxy adhesive (e.g. commercially available from the Dexter Hysol Company—product no. EA9436), or conventional 2-part methacrylate adhesive (e.g. commercially available from the ITW Company—product no. MA310). If adhesive materials are used to secure the seal member 106 in position, the adhesion process may be enhanced if the lower surface 110 of the seal member 106 is physically abraded by sanding, filing, or other conventional processes designed to roughen the lower surface 110. Alternatively, the adhesive system used to secure the seal member 106 to the filter member 94 (e.g. mesh portion 96) may consist of conventional double sided adhesive tape (not shown) secured to and between the seal member 106 and filter member 94. The use of tape materials in this manner will be effective provided that the selected portion of tape does not block the central opening 114 in the seal member 106 and does not chemically react with ink materials in the cartridge unit. An exemplary tape composition suitable for this purpose is manufactured by the 3M Company of Minneapolis, Minn. (USA) under the product designation Y9473.

Regardless of the selected adhesive method, the seal member 106 should be oriented relative to the filter member 94 so that the central longitudinal axis $A_1$ of the seal member 106 (FIG. 2) is axially aligned with the central longitudinal axis $A_2$ of the tubular conduit 81. This configuration ensures that ink materials delivered through the seal member 106 via the central opening 114 will pass directly into the passageway 90 of the conduit 81 for delivery to the printhead 75. Likewise, as noted above, the diameter of the central opening 114 within the seal member 106 should be less than the diameter of the tubular conduit 81 at the point where both of these components meet. As a result, when the seal member 106 and the conduit 81 are axially aligned, ink materials which pass through the central opening 114 will be transferred directly into the passageway 90 of the conduit 81 with little or no fluid leakage outside of and around the conduit 81. Incidentally, if dowels 98 are present within the cartridge unit 10 as shown in FIG. 2, a seal member 106 is selected which is sized for placement between the dowels 98 so that they surround the seal member 106 and are spaced slightly outward therefrom (FIG. 2). Alternatively, the dowels 98 may be physically removed from the cartridge unit 10 prior to attachment of the seal member 106 in position as discussed below.

Finally, with reference to FIG. 2, the inner surface 120 of the retaining wall portion 18 will preferably include a plurality of indentations or notches 122 therein. Each of the notches 122 extends into but not entirely through the retaining wall portion 18. The number and position of the notches 122 may be varied during production, and the present invention shall not be limited in this regard. In a preferred embodiment of the invention as illustrated in FIG. 2, at least one notch 122 is present on the planar interior surface 34 of the first side wall 28, with another notch 122 being present on the planar interior surface 36 of the second side wall 30, with both of the notches 122 in FIG. 2 being directly opposite each other as shown. The function of these notches 122 will be described below. However, it is important to note that the notches 122 may be placed in other locations within the cartridge unit 10 aside from the positions illustrated in FIG. 2. Multiple notches 122 may be positioned within the interior surfaces (not shown) of the top wall 20 and bottom wall 26 in the same manner and position described above relative to the first side wall 28 and second side wall 30. Furthermore, if notches 122 are positioned within the top wall 20 and bottom wall 26, they may be used instead of or in addition to any notches 122 which may be present within the first side wall 28 and second side wall 30. Accordingly, the present invention shall not be limited to any particular number, arrangement, or position regarding the notches 122.

Figure 3:
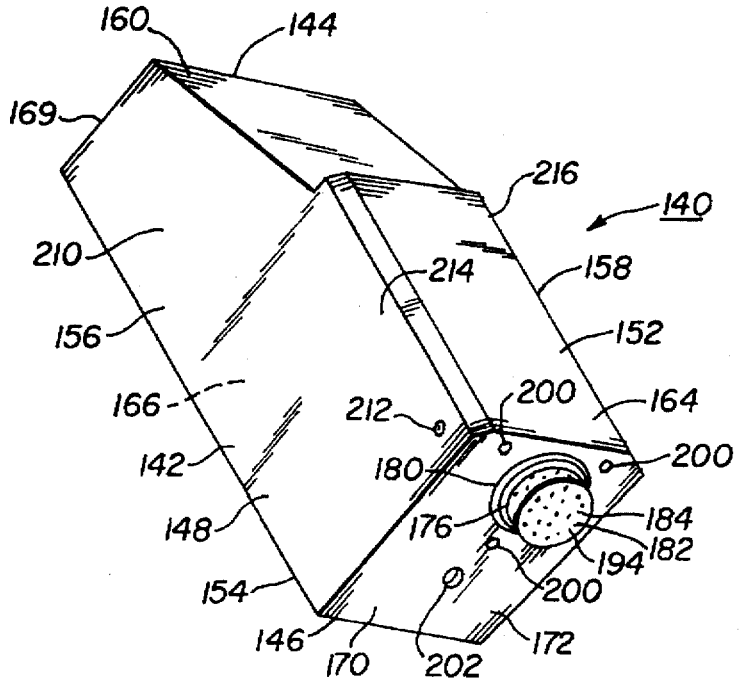
FIG. 3 is a bottom perspective view of an ink cartridge refill unit produced in accordance with a preferred embodiment of the invention which is suitable for use in the cartridge unit of FIG. 1.

With reference to FIGS. 3–6, a refill unit 140 produced in accordance with the invention is illustrated. While the refill unit 140 will be discussed with reference to the cartridge unit 10 shown in FIGS. 1–2, it may be used in a wide variety of other ink cartridge systems. As illustrated in FIG. 3, the refill unit 140 includes a housing 142 which includes an upper portion 144, a lower portion 146, and a side wall portion 148 between the upper and lower portions 144, 146. In the embodiment of FIG. 3, the side wall portion 148 will include a front wall 152, a rear wall 154, a first side wall 156, and a second side wall 158 which basically form the housing 142. In accordance with FIG. 3, the front wall 152 may be divided into two sections 160, 164. Section 160 is part of the upper portion 144 of the refill unit 140 and angles inwardly so that the upper portion 144 has a narrower and thinner configuration compared with the remaining portions of the refill unit 140. As a result, the upper portion 144 is more readily grasped and manipulated by a user of the refill unit 140. The housing 142 is preferably manufactured from a plastic which is strong, inert, and capable of minimizing the evaporation of fluid materials (e.g. ink) therefrom. Exemplary and preferred materials suitable for producing the housing 142 will include but not be limited to: (1) high density polyethylene at a wall thickness of about 0.025 in.; (2) polyethyleneterephthalate at a wall thickness of about 0.060 in.; and (3) polysulfone plastic at a wall thickness of about 0.05 in. Other plastic compositions may be used for this purpose as determined by preliminary pilot studies involving the ink materials to be stored within the refill unit 140. Construction materials selected for producing the housing 142 should be capable of maintaining ink quality within the refill unit 140 for about 18 months or more. Depending on the selected construction material, it may be necessary to package the completed refill unit 140 within a sealed foil/polyethylene bag (not shown) to reduce evaporative losses. The use or need for such a bag may again be determined by preliminary pilot testing.

In a preferred embodiment, the housing 142 (especially the lower portion 146) will have a horizontal cross-sectional configuration which is matched with the horizontal cross-sectional design of the cartridge unit of interest (e.g. square or rectangular in the present embodiment) to ensure proper insertion of the refill unit 140. Accordingly, the present invention shall not be limited to any particular shape or design configuration regarding the refill unit 140. For example, the cross-sectional configuration of the housing 142 could be square, circular, or rectangular depending on its intended use. Regarding the overall size of the housing 142, the length, width, and height thereof will again depend on the cartridge unit to be used with the refill unit 140. However, it is necessary and appropriate that the refill unit 140 have dimensions which allow it to be received within the containment vessel (e.g. vessel 12 shown in FIG. 1) of the selected cartridge unit. It is therefore preferred that the refill unit 140 have a width and thickness which are less than the corresponding width and thickness of the internal chamber within the cartridge unit of interest. In the present case, the housing 142 of the refill unit 140 will have a width and thickness which are less than the corresponding dimensions of the internal chamber 40 within the containment vessel 12 illustrated in FIGS. 1–2. Further information regarding these parameters will be discussed below. Regarding the height of refill unit 140, this parameter will also vary in view of the selected cartridge unit. The refill unit 140 may be shorter than the cartridge unit of interest or longer if desired. The selection of a particular height parameter regarding the refill unit 140 is a matter of design choice in connection with a variety of extrinsic factors. In certain embodiments, it may be desirable to design the refill unit 140 with a greater height than the cartridge unit 10 so that the refill unit 140 extends outwardly therefrom. This design may facilitate insertion and/or removal of the refill unit 140.

Figure 4:
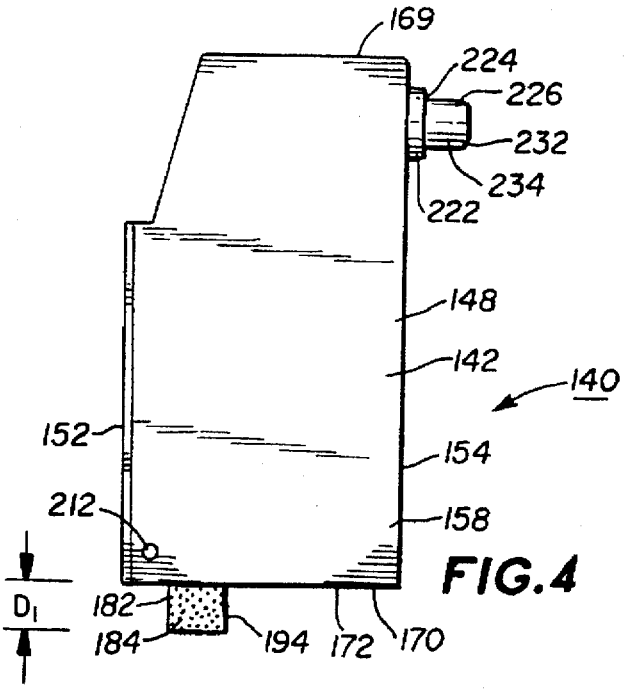
FIG. 4 is a side view of the refill unit of FIG. 3.
Figure 5:
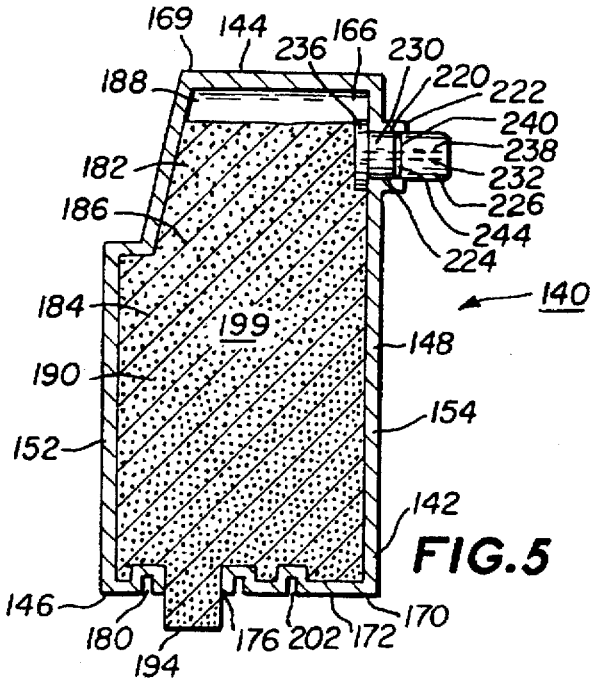
FIG. 5 is a partial cross-sectional view of the refill unit of FIG. 4 which illustrates the internal components thereof including the pressure-exerting member in a rest position.

With reference to FIG. 5, the housing 142 includes an internal cavity 166 therein which is surrounded by the side wall portion 148. The purpose of the internal cavity 166 will be described below. As illustrated in FIG. 5, the upper portion 144 of the housing 142 includes an upper panel member 169. Likewise, the lower portion 146 of the housing 142 includes a substantially planar lower panel member 170 with an exterior surface 172. Passing through the lower panel member 170 at a position adjacent the front wall 152 of the housing 142 is an opening 176. In the preferred embodiment of FIG. 3, the opening 176 is substantially circular in shape, although other embodiments may involve different shapes associated with the opening 176 (e.g. square or rectangular). The opening 176 passes entirely through the lower panel member 170 and permits access to the internal cavity 166 within the housing 142. Surrounding the opening 176 in the embodiment of FIG. 3 and located slightly outward therefrom is a continuous, inwardly-extending annular channel 180 positioned within the exterior surface 172 of the panel member 170. The annular channel 180 is substantially circular as shown in FIG. 3. As discussed below, the annular channel 180 is designed to receive the annular seal member 106 in a fluid-tight manner. In this regard, the annular channel 180 should be substantially the same size or slightly smaller than the annular seal member 106 so that the seal member 106 is compressively engaged within the channel 180. So that the annular channel 180 may receive the seal member 106 therein, channel 180 and seal member 106 should incorporate the same basic design shape (e.g. circular as illustrated in the embodiment of FIGS. 1–6). Alternatively, if the seal member 106 is non-circular in configuration, the channel 180 will be correspondingly non-circular and identically shaped. In this regard, the term "annular" as used in connection with the channel 180 may involve a comparable design which is ring-like, yet non-circular in cross-section. For example, the channel 180 may be rectangular or square depending on a variety of production parameters and other considerations, including the design of the seal member 106 as previously discussed. Finally, as noted above, the channel 180 does not pass entirely through the lower panel member 170 and instead extends only partially therethrough. In a preferred embodiment, the channel 180 will have a depth which is at least about 50% of the thickness of the lower panel member 170.

Positioned within and substantially filling the internal cavity 166 in the refill unit 140 is a fluid absorbent member 182 illustrated in FIGS. 3–5. In a preferred embodiment, the fluid absorbent member 182 will consist of a foam member 184 of a type normally used to retain ink within a printing system. The foam member 184 includes a plurality of cells 186 which are schematically illustrated in FIG. 5 and designed to retain ink in accordance with known capillary phenomena. The foam member 184 may be made from the same materials used to construct any foam blocks which may be used in the cartridge unit 10 as described above. Specifically, the foam member 184 may be constructed from a wide variety of commercially available multi-cellular materials including but not limited to (1) conventional ether-type polyurethane foam materials (e.g. obtainable from the Scott Paper Company of Philadelphia, Pa. (USA) and described in U.S. Pat. No. 4,771,295 to Baker et al.) which have a porosity of about 60–75 pores per inch; (2) reticulated cellulose as described in U.S. Pat. No. 4,794,409 to Cowger et al.; (3) polyethylene foam as set form in U.S. Pat. No. 4,306,245 to Kasugayama et al.; and (4) melamine-formaldehyde condensate foam as described in U.S. Pat. Nos. 4,929,969 to Morris and 4,511,678 to Manhke et al. which is commercially available from BASF Aktiengesellschaft of Germany. Other multi-cellular foam materials which may be used to construct the foam member 184 include but are not limited to ether-type polyurethane foam with a porosity of about 75–90 pores/cells per inch which is commercially available from Foamex, Inc. of Eddystone, Pa. (USA). Accordingly, the present invention shall not be limited to any particular foam or non-foam materials in connection with the ink retention system of the refill unit 140.

In a preferred embodiment, the foam member 184 is sized so that it is effectively compressed when positioned within the internal cavity 166, thereby preventing undesired lateral and axial movement of the foam member 184 during operation of the refill unit 140 and avoiding the entrapment of air bubbles around the foam member 184. Likewise, the foam member 184 may occupy substantially all of the internal cavity 166 of the housing 142, or may only occupy part of the cavity 166, leaving a gap 188 within the upper portion of 144 of the housing 142 as illustrated in FIG. 5. With continued reference to FIG. 5, the foam member 184 further includes a main portion 190 which effectively resides within the internal cavity 166 of the housing 142 and a lower section 194 which extends outwardly (e.g. downwardly) through the opening 176 in the lower panel member 170. In particular, the lower section 194 extends downwardly beyond the exterior surface 172 of the lower panel member 170 and is located outwardly from the housing 142 as illustrated.

As described below, the downward/outward configuration of the lower section 194 provides secure and complete physical engagement between the ink-retaining foam member 184 and various components of the ink delivery system (e.g. the filter member 94) associated with the cartridge unit 10. As a result, ink delivery from the refill unit 140 to the printhead 75 in the cartridge unit 10 can occur with a high degree of efficiency. In a preferred embodiment, the lower section 194 of the foam member 184 will extend downwardly from the exterior surface 172 of the lower panel member 170 by a distance $D_1$ (FIG. 4) of about 4.0–6.0 mm. However, the present invention shall not be limited to this numerical range which is provided for example purposes only. Regarding the cross-sectional configuration of the lower section 194, it is substantially circular in the embodiment of FIGS. 3–5 in order to correspond with the circular configuration of the opening 176 in the lower panel member 170, as well as the circular central opening 114 in the seal member 106 within cartridge unit 10. As discussed below, the lower section 194 of the foam member 184 will be received within the central opening 114 of the seal member 106 when the refill unit 140 is positioned within the cartridge unit 10. For this reason, dimensional conformity between the central opening 114 of the seal member 106 and the lower section 194 is desirable and appropriate. To ensure dimensional conformity between the foregoing elements, it is likewise preferred that the diameter of the lower section 194 be equal to or slightly less than the diameter of the central opening 114 so that the lower section 194 may fit readily therein. It should also be noted that the present invention shall not be limited to a foam member 184 having a lower section 194 which is circular in cross-section as illustrated in FIG. 3. Other dimensional configurations may be used, depending on the shape of the opening 176 in the lower panel member 170, and the design of the seal member 106 and central opening 114 therein. In this regard, the lower section 194 of the foam member 184 may be square, rectangular, or otherwise non-circular in cross-section.

The foam member 184 may be positioned within the internal cavity 166 of the refill unit 140 in many different ways during production of the housing 142. For example, the housing 142 can be produced so that the upper panel member 169 is initially a separate component relative to the other parts of the housing 142, with the upper portion 144 thereof being open prior to attachment of the upper panel member 169 in position. In this regard, the foam member 184 could be initially inserted within the internal cavity 166 of the housing 142, followed by attachment of the upper panel member 169 in position using adhesive compositions (e.g. cyanoacrylate glue) or thermal/ultrasonic welding. Alternatively, many different methods can be used to construct the housing 142 so that the foam member 184 may be inserted during the production process, and the present invention shall not be limited to any particular method for manufacturing the housing 142 and inserting the foam member 184.

As indicated above, the foam member 184 is saturated with a supply of ink therein as schematically illustrated in FIG. 5 at reference number 199. Any type of ink may be used within the foam member 184, provided that it is compatible with the components of the selected cartridge unit 10 and provides acceptable performance. For example, the ink materials normally supplied by the Hewlett-Packard Company of Palo Alto Calif. (USA) in its cartridge nos. 51626A, 51608A, 51639A, 51639C, 51639M, 51639Y, 51633A, and 51629A may likewise be used in the refill unit 140. Additional exemplary ink compositions suitable for use in the foam member 184 will include those listed in U.S. Pat. No. 4,963,189 to Hindagolla which is incorporated herein by reference. In this regard, the present invention shall not be limited to the use of any particular ink materials.

The lower panel member 170 of the refill unit 140 includes various additional features shown in FIG. 3. For example, a plurality of individual bores 200 are provided within the lower panel member 170 which are circumferentially arranged around and spaced outwardly from the annular channel 180. Each of the bores 200 begins at the exterior surface 172 of the lower panel member 170 and extends partially inward but does not pass entirely through the panel member 170. In a preferred embodiment, the bores 200 will each have a depth which is equal to about 50% of the thickness of the lower panel member 170. The bores 200 in the embodiment of FIG. 3 are sized to receive the dowels 98 therein when the refill unit 140 is positioned within the cartridge unit 10. In this regard, each bore 200 will preferably have an internal diameter which is greater than the diameter of the dowel 98 to be received therein. The number and position of the bores 200 within the lower panel member 170 will depend on the number and position of the dowels 98 being used in a selected cartridge unit. Accordingly, the quantity and location of the bores 200 will vary in view of the type of cartridge unit being employed. It should also be noted that the bores 200 may be omitted if the selected cartridge unit is of a type which does not include any dowels 98, or if the dowels 98 are removed prior to insertion of the refill unit 140.

With continued reference to FIG. 3, the lower panel member 170 of the housing 142 further may further include at least one optional recessed portion 202 therein which is positioned between the lower section 194 of the foam member 184 and the rear wall 154 of the housing 142. The recessed portion 202 begins at the exterior surface 172 of the lower panel member 170 and extends inwardly but not entirely through the panel member 170 (e.g. partially within the panel member 170). In this regard, the recessed portion 202 will preferably have an average depth which is about 50% of the thickness of the lower panel member 170. The recessed portion 202 is designed to receive any components therein which may be internally disposed within the bottom portion 16 of the cartridge unit 10. For example, in certain commercially-available inkjet cartridges (e.g. those manufactured by the Hewlett-Packard Company under the product designation 51626A), a bubble generator system is provided which includes an upwardly-extending conduit with a spherical ball member therein. The recessed portion 202 can be used to accommodate any of the foregoing structures which may be present within the selected cartridge unit, and will ensure proper mating engagement between the refill unit 140 and the selected cartridge. While the recessed portion 202 illustrated in the embodiment of FIG. 3 is circular in cross-section, the present invention shall not be limited to this particular design. Depending on the specific elements to be received within the recessed portion 202, it may likewise be non-circular (e.g. square or rectangular) in cross-section. Finally, an additional view of the recessed portion is presented in FIG. 5 (wherein bores 200 have been omitted for the sake of clarity).

Figure 7:
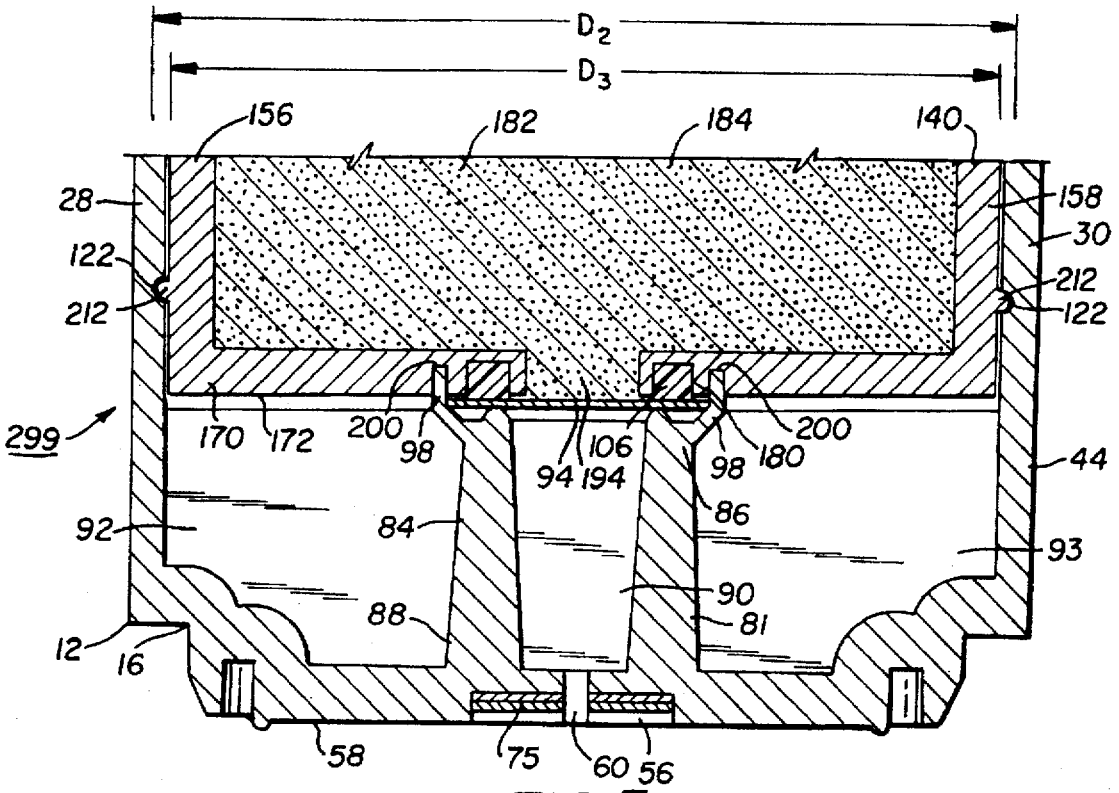
FIG. 7 is an enlarged partial cross-sectional view taken along line 2—2 of FIG. 1 illustrating the cartridge unit of FIG. 1 after placement of the refill unit of FIG. 3 therein (also shown in cross-section).

An additional feature of the refill unit 140 is illustrated in FIGS. 3 and 7. Specifically, the outer surface 210 of the side wall portion 148 includes a plurality of outwardly-extending projections or tab members 212 integrally formed thereon (e.g. fixedly secured thereto). The number and position of the tab members 212 may be varied during production, and the present invention shall not be limited in this regard. However, as discussed below, the tab members 212 are sized and designed for engagement with the notches 122 in the cartridge unit 10. To accomplish the desired interaction between tab members 212 and notches 122, it is preferred that the number and arrangement of the tab members 212 on the refill unit 140 correspond with the number and arrangement of the notches 122 within the cartridge unit 10 so that each tab member 212 will fit within one of the notches 122 to ensure secure, mating engagement of the refill unit 140 as it snaps into the cartridge unit 10. In a preferred embodiment as illustrated in FIGS. 3 and 7, at least one tab member 212 is present on the planar exterior surface 214 of the first side wall 156, with another tab member 212 being present on the planar exterior surface 216 of the second side wall 158, with both of the tab members 212 illustrated in FIG. 7 being directly opposite each other as shown and inserted within the notches 122 illustrated in FIG. 7. As a result, the refill unit 140 is firmly retained within the cartridge unit 10 as further discussed below. However, it is important to note that the tab members 212 may be placed at other positions on the outer surface of the 210 of the side wall portion 148 associated with housing 142 aside from the positions illustrated in FIGS. 3 and 7. For example, multiple tab members 212 may be positioned on the exterior surfaces (not shown) of the front wall 152 and rear wall 154 of the housing 142 in the same manner and position described above relative to the first side wall 156 and the second side wall 158, provided that corresponding notches 122 are present within the top wall 20 and bottom wall 26 of the cartridge unit 10. Furthermore, if additional tab members 212 are positioned on the exterior surfaces of the front wall 152 and rear wall 154 of the housing 142, they may be used instead of or in addition to any tab members 212 which may be present on the first side wall 156 and second side wall 158. Accordingly, the present invention shall not be limited exclusively to any particular number, arrangement, or position of tab members 212 (and corresponding notches 122).

Figure 6:
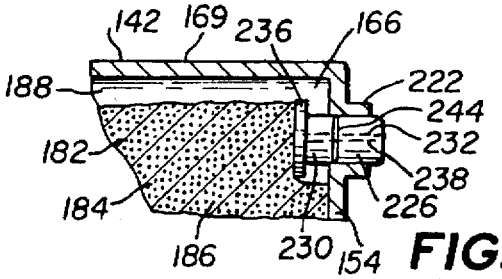
FIG. 6 is a sectional view of FIG. 5 illustrating the pressure exerting member in a forward (active) position in order to exert pressure on the fluid absorbent member within the refill unit.

Finally, as illustrated in FIGS. 4–6, a priming system is provided in order to ensure continuous and efficient ink delivery from the refill unit 140. As shown in FIG. 5, the side wall portion 148 (particularly the rear wall 154 in the vicinity of the upper portion 144) includes a port 220 therein. The port 220 provides access to the foam member 184 within the internal cavity 166 of the housing 142. Extending outwardly from the rear wall 154 and surrounding the port 220 is a tubular sleeve 222 having a passageway 224 therein which communicates with the port 220 (FIGS. 4–5). Positioned within the port 220 and passageway 224 is an elongate pressure-exerting member 226 (shown non-cross-sectionally in FIGS. 5–6), part of which extends outwardly from the tubular sleeve 222 when the pressure-exerting member 226 is not in use (e.g. in a rest position). The pressure-exerting member 226 includes an inner end 230, an outer end 232, and a medial section 234 between the inner and outer ends 230, 232. In the embodiment of FIGS. 3–6, the pressure-exerting member 226 is uniformly circular in cross-section from the inner end 230 to the outer end 232. To facilitate movement of the pressure exerting member 226 within the port 220 and passageway 224 through the tubular sleeve 222, the pressure exerting member 226 has a diameter which is smaller than the diameter of both the port 220 and the passageway 224. It should be noted that the present invention shall not be limited to the use of a pressure-exerting member 226 which is circular in cross-section. Alternatively, other cross-sectional configurations may be used, including those which are square or rectangular. If a non-circular cross-sectional design is used in connection with the pressure-exerting member 226, a corresponding design should likewise be selected for the port 220 and passageway 224 through the tubular sleeve 222.

As illustrated in FIG. 5, the inner end 230 of the pressure-exerting member 226 is located within the internal cavity 166 of the housing 142 and is positioned adjacent the foam member 184. In a preferred embodiment, the inner end 230 further includes a planar panel member 236 secured thereto which is designed to come in contact with the foam member 184 during a priming operation. The outer end 232 is located outside of the internal cavity 166 and housing 142. Extending continuously through the pressure-exerting member 226 from the inner end 230 to the outer end 232 is an elongate bore 238 (shown in dashed lines in FIG. 5), the function of which will be described below. Finally, with continued reference to FIG. 5, the medial section 234 of the pressure exerting member 226 includes a groove 240 therein which extends around the entire circumference of the member 226. Fitted within the groove is a resilient o-ring 244 (e.g. made of rubber or other comparable material which, when compressed, will exert counter-pressure in an attempt to return to its original configuration). The o-ring 244 is designed to engage the interior surface of the tubular sleeve 222 to provide a sliding, dynamic seal between the pressure-exerting member 226 and the tubular sleeve 222.

As shown in FIG. 5, the pressure-exerting member 226 is in a rest position wherein the outer end 232 is located entirely outside of the tubular sleeve 222, with the panel member 236 being positioned directly adjacent and against the rear wall 154. To prime the refill unit 140, the outer end 232 of the pressure-exerting member 226 is pushed inwardly, causing the panel member 236 on the inner end 230 to come in contact with and compress the foam member 184 as illustrated in FIG. 6. As the pressure-exerting member 226 is pushed inwardly, the user's finger blocks the bore 238 at the outer end 232 of the member 226. This causes air to be trapped inside the bore 238 which is conveyed into the internal cavity 166 of the housing 142. Accordingly, proper ink delivery is facilitated by the resulting increase in pressure levels within the housing 142. Extraneous and uncontrolled air entry into the internal cavity 166 via the space between the pressure-exerting member 226 and the tubular sleeve 222 is prevented by the o-ring 244 which again creates a dynamic seal between both of these components. In addition, use of the tubular sleeve 222 prevents the pressure-exerting member 226 from being pushed entirely into the internal cavity 166 of the housing 142. After priming is completed, the pressure-exerting member 226 automatically returns to the rest position illustrated in FIG. 5 by outward expansion of the resilient foam member 184 against the panel member 236 at the inner end 230 of the member 226. Furthermore, once the user's finger is released from the outer end 232 of the pressure-exerting member 226, the bore 238 is effectively opened which permits a proper degree of pressure equalization to occur within the internal cavity 166 so that ink delivery can proceed in rapid and efficient manner.

Finally, in addition to or instead of retaining the refill unit 140 within a foil/polyethylene bag as previously discussed, the upper portion 144, the lower portion 146 or both may be fitted with a selected cover, cap member, or comparable structure (not shown) to further prolong shelf life of the product by preventing ink evaporation. If a cover member is used in connection with the upper portion 144, it should effectively cover the tubular sleeve 222.

To use the refill unit 140 within ink cartridge unit 10, the cap member 100 illustrated in FIG. 1 is removed along with any ink retaining structures within the internal chamber 40 (e.g. bladders, foam members, or spring-bag mechanisms). Thereafter, if not already undertaken, the previously-described modifications are made to the cartridge unit 10 including but not limited to addition of the notches 122 and annular seal member 106. Next, the refill unit 140 is positioned directly above the open top portion 14 of the cartridge unit 10 and oriented so that the printhead 75 is aligned with and directly beneath the lower section 194 of the foam member 184 associated with the refill unit 140. The refill unit 140 is then inserted through the open top portion 14 of the cartridge unit 10 so that it moves downwardly and is positioned within internal chamber 40 of the cartridge unit 10. Because the distance $D_2$ (FIG. 7) between the tab members 212 on the refill unit 140 is slightly greater than the distance $D_3$ between the first side wall 28 and second side wall 30 of the cartridge unit 10, the tab members 212 will engage the walls 28, 30 during insertion of the refill unit 140, causing the walls 28, 30 to bend slightly outward (which is possible due to the resilient character of the materials used to construct the containment vessel 12 of the cartridge unit 10.)

The refill unit 140 is continuously urged downwardly through the internal chamber 40 of the cartridge unit 10 until the annular seal member 106 of the cartridge unit 10 is firmly and securely positioned within the annular channel 180 in a substantially fluid-tight manner as illustrated in FIG. 7. In this orientation, the refill unit 140 is properly aligned with the cartridge unit 10, with the lower section 194 of the foam member 184 being firmly and secured urged (compressively engaged) against the filter member 94 (e.g. mesh portion 96) to ensure fluidic contact between these components, as well as efficient and continuous ink transfer from the refill unit 140 to the printhead 75. Likewise, in this configuration, the lower section 194 of the foam member 184 is entirely surrounded and contained within the central opening 114 of the annular seal member 106 to ensure a substantially fluid-tight relationship between the refill unit 140 and the cartridge unit 10. Regarding the dowels 98, they are entirely positioned within the bores 200 as illustrated. Finally, as shown in FIG. 7, the notches 122 and tab members 212 are respectively positioned on the cartridge unit 10 and refill unit 140 so that each of the tab members 212 is engaged within one of the notches 122 when the refill unit 140 has reached its desired location within the cartridge unit 101. In this manner, the refill unit 140 is securely retained within the cartridge unit 10 to produce a highly-efficient printing assembly 299 shown in FIG. 7.

Use of the refill unit 140 described above provides numerous important benefits including but not limited to: (1) consumer cost reductions; and (2) more efficient use of resources resulting in a decrease in the generation of waste materials. Regarding the efficient use of resources, it is anticipated that each cartridge unit 10 may be refilled (e.g. supplied with an additional refill unit 140) between about 4–5 times, depending on the structural design of the particular cartridge unit under consideration as determined by preliminary pilot studies. Thus, the present invention described above represents an advance in the art of ink cartridge technology.

Figure 8:
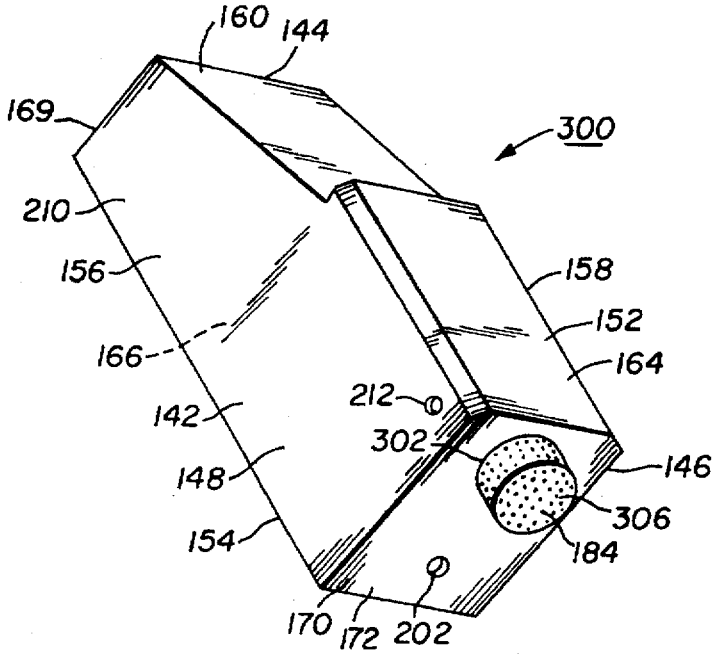
FIG. 8 is a bottom perspective view of an ink cartridge refill unit produced in accordance with an alternative embodiment of the invention which is suitable for use in the cartridge unit of FIG. 1 (with certain modifications).
Figure 9:
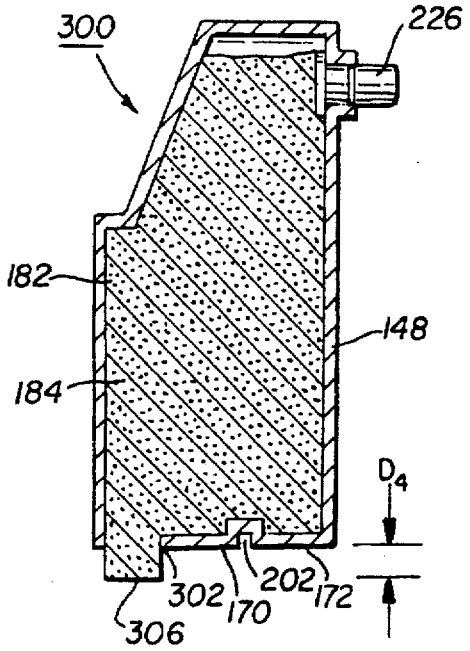
FIG. 9 is a cross-sectional view of the refill unit of FIG. 8 which illustrates the internal components thereof including the pressure-exerting member in a rest position.
Figure 10:
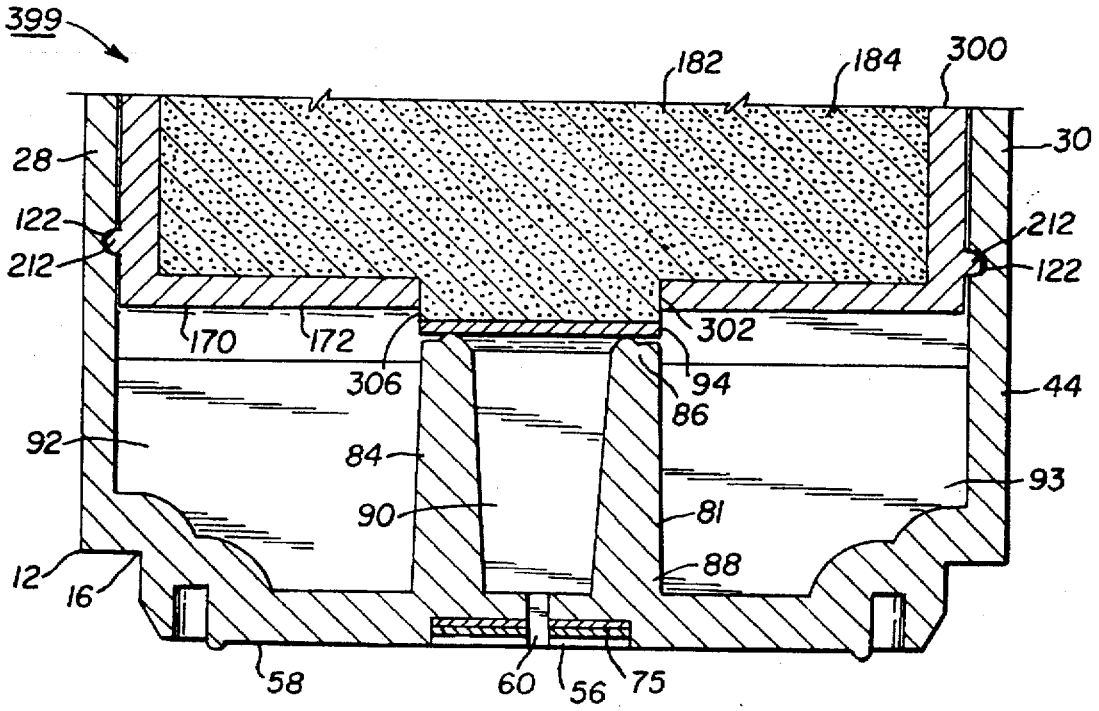
FIG. 10 is an enlarged partial cross-sectional view taken along line 2—2 of FIG. 1 illustrating the cartridge unit of FIG. 1 after placement of the refill unit of FIG. 8 therein (also shown in cross-section).

A number of possible variations exist regarding the ink refill system described above. Alternative embodiments of the present invention are illustrated in FIGS. 8–12. In describing these embodiments, reference numbers carried over from the embodiment of FIGS. 1–7 will represent components which remain the same in the embodiments of FIGS. 8–12. With reference to FIGS. 8–10 a first alternative embodiment of the present invention is illustrated. Specifically, a refill unit 300 is disclosed which is comparable to refill unit 140 with certain modifications as described below. The refill unit 300 in the present embodiment is designed for use with the cartridge unit 10 initially shown in FIGS. 1–2. The only differences regarding the cartridge unit 10 as used in this embodiment of the invention are the following: (1) absence of the annular seal member 106; and (2) absence of the dowels 98 which were either not initially present or were subsequently removed. The other features of the cartridge unit 10 as described above (e.g. notches 122, printhead 75, and the like) are present in this alternative embodiment.

Regarding the refill unit 300 of FIGS. 8–10, it includes substantially all of the features, elements, and components of refill unit 140 with certain exceptions. First, the refill unit 300 does not include the channel 180 and bores 200 in the lower panel member 170 which were present in refill unit 140. Also, in the present embodiment, the refill unit 300 includes an enlarged, reconfigured opening 302 in the lower panel member 170 which is preferably larger than the opening 176 illustrated in FIG. 3 and is circular in cross-section although other cross-sectional configurations may be used (e.g. square or rectangular) The reconfigured opening 302 is designed to accommodate a modified lower section 306 associated with the foam member 184 within the internal cavity 166 of the housing 142. The modified lower section 306 includes a cross-sectional configuration corresponding with that of the reconfigured opening 302 (e.g.

preferably circular or otherwise, depending in the configuration of opening 302). In particular, the modified lower section 306 is optimally sized to have a length, width, and/or diameter substantially equal to or greater than the corresponding dimensions of the ink filter member 94 (e.g. mesh portion 96) used in the cartridge 10. As a result, the lower section 306 will come in contact with and entirely cover the filter member 94 when the refill unit 300 is mounted within the cartridge unit 10 (FIG. 10). It should also be noted that the modified lower section 306 of the foam member 184 extends downwardly from the exterior surface 172 of the lower panel member 170 by a distance $D_4$ so that the lower section 306 is located outside of the housing 142. This distance is substantially identical with the distance $D_1$ listed above and illustrated in FIG. 4 regarding the lower section 194 in the initial embodiment of the present case. All of the other features associated with the refill unit 300 in this embodiment remain unchanged compared with refill unit 140 (including use of the pressure-exerting member 226, tab members 212, recessed portion 202, and the like).

To use the refill unit 300 of FIGS. 8–10 within ink cartridge unit 10, the cap member 100 illustrated in FIG. 1 is again removed along with any ink retaining structures which may be present within the internal chamber 40 (e.g. bladders, foam members, or spring-bag mechanisms). Next, the refill unit 300 is positioned directly above the open top portion 14 of the cartridge unit 10 and oriented so that the printhead 75 is axially aligned with and directly beneath the modified lower section 306 of the foam member 184 associated with the refill unit 300. The refill unit 300 is then inserted through the open top portion 14 of the cartridge unit 10 so that it moves downwardly and is positioned within internal chamber 40 of the cartridge unit 10. In the same manner describe above, the tab members 212 engage the side walls 28, 30 of the cartridge unit 10 during insertion of the refill unit 300, causing the walls 28, 30 to bend slightly outward (due to the resilient character of the materials used to construct the containment vessel 12 of the cartridge unit 10).

The refill unit 300 is continuously urged downwardly through the internal chamber 40 of the cartridge unit 10 until the modified lower section 306 of the foam member 184 is positioned against and in direct physical/fluidic contact (compressively engaged) with the ink filter member 94 (e.g. mesh portion 96) at all positions thereon so that the filter member 94 is entirely covered by the lower section 306. In this orientation (shown in FIG. 10), the refill unit 300 is properly aligned within the cartridge unit 10, with the modified lower section 306 of the foam member 184 being firmly and secured urged against the filter member 94 (e.g. mesh portion 96) to ensure efficient and continuous ink transfer to the printhead 75 of the cartridge unit 10. Finally, as shown in FIG. 10 and previously discussed, the notches 122 and tab members 212 are respectively positioned on the cartridge unit 10 and refill unit 300 so that each of the tab members 212 snaps in and is engaged within one of the notches 122 when the refill unit 300 has reached its desired location within the cartridge unit 10. In this manner, the refill unit 300 of the embodiment associated with FIGS. 8–10 is securely retained within the cartridge unit 10 to produce a highly-efficient printing assembly 399 shown in FIG. 10.

Figure 11:
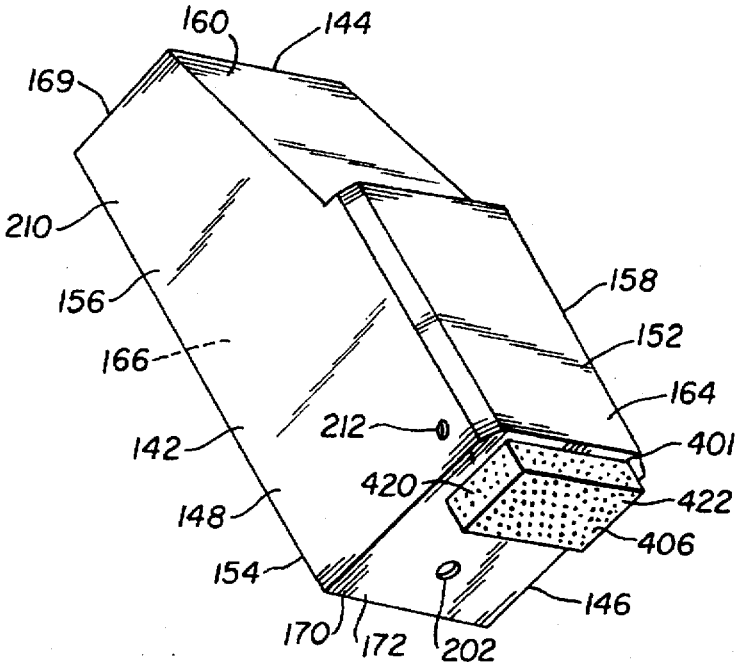
FIG. 11 is a bottom perspective view of an ink cartridge refill unit produced in accordance with a still further alternative embodiment of the invention which is suitable for use in the cartridge unit of FIG. 1 (with certain modifications).
Figure 12:
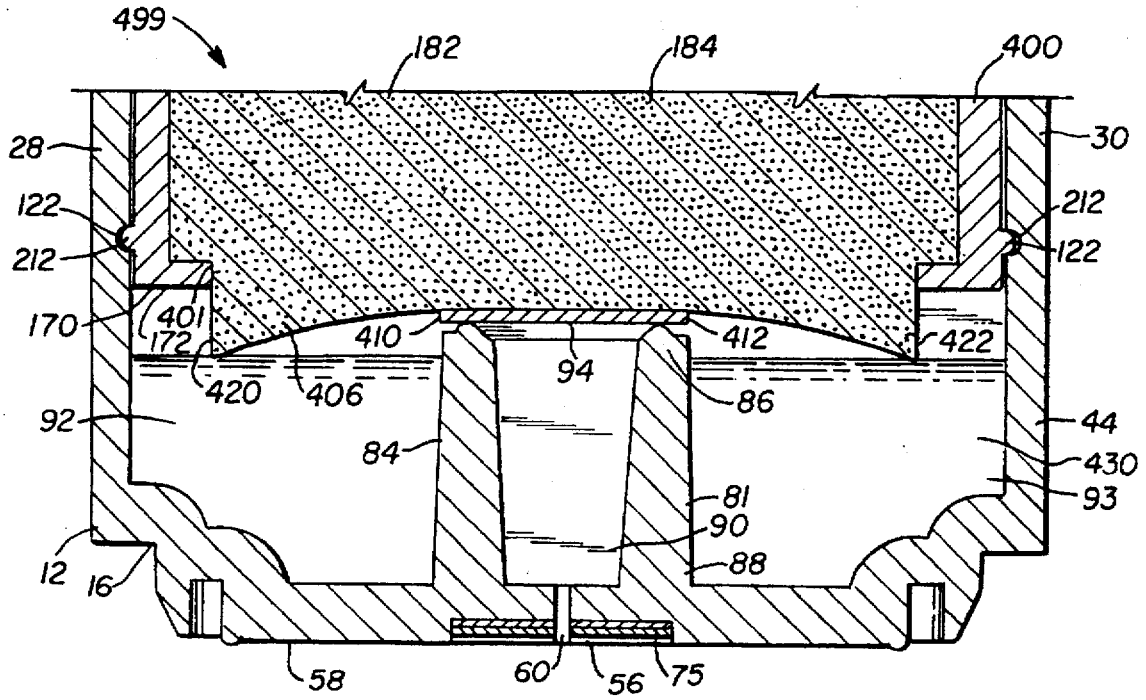
FIG. 12 is an enlarged partial cross-sectional view taken along line 2—2 of FIG. 1 illustrating the cartridge unit of FIG. 1 after placement of the refill unit of FIG. 11 therein (also shown in cross-section).

A final embodiment of the present invention is illustrated in FIGS. 11–12. A refill unit 400 is also used which is comparable to the refill unit 140 with certain modifications as described below. Likewise, the refill unit 400 in this final embodiment is designed for use with the cartridge unit 10 initially shown in FIGS. 1–2. The cartridge unit 10 used in the final embodiment described herein is again characterized by: (1) absence of the annular seal member 106; and (2) absence of the dowels 98 which were either not initially present or were subsequently removed. The other features of the cartridge unit 10 (e.g. notches 122, printhead 75, and the like) are present in this embodiment.

Regarding the refill unit 400 of FIGS. 11–12, it likewise includes substantially all of the features, elements, and components described above regarding the refill unit 140 with certain exceptions. First, the refill unit 400 in the present embodiment again does not include the channel 180 and bores 200 in the lower panel 170 which were used in refill unit 140. Also, in the present embodiment, the refill unit 400 includes an enlarged opening 401 in the lower panel member 170 which is preferably larger than the opening 176 illustrated in FIG. 3 or the reconfigured opening 302 shown in FIG. 8. The enlarged opening 401 in the present embodiment is optimally rectangular in cross-section. It is particularly designed to accommodate an enlarged lower section 406 associated with the foam member 184 in the internal cavity 166 of the housing 142. The enlarged lower section 406 includes a cross-sectional configuration which corresponds with that of the opening 401 (e.g. rectangular). In addition, the enlarged lower section 406 is optimally sized to have a width substantially equal with that of the ink filter member 94 (e.g. mesh portion 96) used in the cartridge 10, and a length with substantially exceeds the length of the filter member 94 so that the lower section 406 will not only come in contact with and cover the entire filter member 94, but will also extend beyond both of the outer edges 410, 412 (FIG. 12) of the filter member 94. Furthermore, it is preferred that the lower section 406 (and opening 401) have a length which is substantially equal to the distance between the first side wall 156 and the second side wall 158 as shown in FIG. 11. In this regard, the enlarged lower section 406 will preferably include dual outwardly-extending end portions 420, 422, with the end portion 420 extending beyond the outer edge 410 of the filter member 94 and end portion 422 extending beyond the outer edge 412 of the filter member 94. As described below and illustrated in FIG. 12, the end portions 420, 422 are respectively designed to extend over and partially into the ink drainage compartments 92, 93 of cartridge unit 10 illustrated in FIG. 12. Incidentally, if the selected ink cartridge unit 10 uses only a single ink drainage compartment (either compartment 92 or 93), then the enlarged lower section 406 may include only a single outwardly-extending end portion as needed (either end portion 420 or 422). Finally, it should be noted that the enlarged lower section 406 of the foam member 184 extends downwardly from the exterior surface 172 of the lower panel member 170 by the same distance described above regarding lower section 194 in refill unit 140 (e.g. $D_1$) so that the lower section 406 is located outside of the housing 142. This distance is substantially identical with the distance $D_1$ listed above and illustrated in FIG. 4 regarding the lower section 194 in the initial embodiment of this case. All of the other features associated with the refill unit 400 in the present embodiment remain unchanged (including use of the pressure-exerting member 226, tab members 212, recessed portion 202, and the like). Furthermore, the cross-sectional view of the refill unit 400 of FIG. 11 is substantially identical with the cross-section view of the refill unit 300 in the previous embodiment as illustrated in FIG. 9.

To use the modified refill unit 400 of FIGS. 11–12 within ink cartridge unit 10, the cap member 100 illustrated in FIG. 1 is again removed along with any ink retaining structures in the internal chamber 40 (e.g. bladders, foam members, or spring-bag mechanisms). Next, the refill unit 400 is positioned directly above the open top portion 14 of the cartridge unit and oriented so that the printhead 75 is axially aligned with and directly beneath the enlarged lower section 406 of the foam member 184 associated with the refill unit 400. The refill unit 400 is then inserted through the open top portion 14 of the cartridge unit 10 so that it moves downwardly and is positioned within internal chamber 40 of the cartridge unit 10. In the same manner described above, the tab members 212 engage the side walls 28, 30 of the cartridge unit 10 during insertion of the refill unit 400, causing the side walls 28, 30 to bend slightly outward (due to the resilient character of the materials used to construct the containment vessel 12 of the cartridge unit 10).

The refill unit 400 is continuously urged downwardly through the internal chamber 40 of the cartridge unit 10 until the enlarged lower section 406 is positioned against and in direct physical/fluidic contact with the ink filter member 94 (e.g. mesh portion 96) at all positions thereon so that the filter member 94 is entirely covered by the lower section 406. In this orientation (shown in FIG. 12), the refill unit 400 is properly aligned with the cartridge unit 10, with the lower section 406 of the foam member 184 being firmly and securely urged (compressively engaged) against the filter member 94 (e.g. mesh portion 96) to ensure efficient and continuous ink transfer to the printhead 75 of the cartridge unit 10. Furthermore, in the orientation shown in FIG. 12, the end portion 420 of the lower section 406 extends beyond the outer edge 410 of the filter member 94, with the end portion 422 extending beyond the outer edge 412 of filter member 94. As a result of this design and because the other portions of lower section 406 are substantially compressed against the filter member 94, the end portion 420 is positioned over the ink drainage compartment 92 and tilted slightly downward so that it partially resides within the compartment 92 (FIG. 12). Likewise, the end portion 422 is being positioned over and tilted slightly downward relative to the ink drainage compartment 93 so that it partially resides within the compartment 93. In this manner, residual ink 430 within the compartments 92, 93 is respectively drawn into the end portions 420, 422 by capillary action during use of the refill unit 400 so that the residual ink 430 may ultimately be supplied to the printhead 75 by the foam member 184 during the printing process. Finally, as shown in FIG. 12 and previously discussed, notches 122 and tab members 212 are respectively positioned on the cartridge unit 10 and refill unit 400 so that each of the tab members 212 snaps in and is engaged within one of the notches 122 when the refill unit 400 has reached its desired location within the cartridge unit 10. In this manner, the refill unit 400 of the embodiment associated with FIGS. 11–12 is securely retained within the cartridge unit 10 to produce a highly-efficient printing assembly 499 shown in FIG. 12.

The present invention as described above represents an advance in the art of ink cartridge technology. As previously discussed, the invention provides numerous benefits including but not limited to (1) a reduction in consumer costs; and (2) more efficient use of resources resulting in a decrease in the generation of waste materials. Having herein described preferred embodiments of the invention, it is anticipated that suitable modifications may be made thereto by individuals skilled in the art which nonetheless remain within the scope of the invention. In this regard, the present invention shall only be construed in accordance with the following claims:

The invention that is claimed is:

1. A refill unit designed for insertion within an empty ink cartridge unit comprising:

a housing sized for placement within said empty ink cartridge unit, said housing comprising an upper portion, a lower portion, a side wall portion between said upper portion and said lower portion, and an internal cavity within said housing and surrounded by said side wall portion, said lower portion comprising a lower panel member which comprises at least one opening therethrough in order to provide access to said internal cavity within said housing, said lower panel member further comprising an exterior surface and a continuous annular channel separate from said opening, said annular channel being positioned within said exterior surface of said lower panel member and spaced outwardly from said opening, said annular channel entirely surrounding said opening through said lower panel member;

a fluid absorbent member positioned within said internal cavity of said housing, said fluid absorbent member comprising a lower section extending outwardly from said opening in said lower panel member and beyond said exterior surface of said lower panel member so that said lower section is located outside of said housing; and a supply of ink retained within said fluid absorbent member.

2. A refill unit designed for insertion within an empty ink cartridge unit comprising:

a housing sized for placement within said empty ink cartridge unit, said housing comprising an upper portion, a lower portion, a side wall portion between said upper portion and said lower portion which comprises at least one port therethrough, and an internal cavity within said housing and surrounded by said side wall portion, said lower portion comprising a lower panel member which comprises at least one opening therethrough in order to provide access to said internal cavity within said housing, said lower panel member further comprising an exterior surface and a continuous annular channel separate from said opening, said annular channel being positioned within said exterior surface of said lower panel member and spaced outwardly from said opening, said annular channel entirely surrounding said opening through said lower panel member;

a fluid absorbent member positioned within said internal cavity of said housing, said fluid absorbent member comprising a lower section extending outwardly from said opening in said lower panel member and beyond said exterior surface of said lower panel member so that said lower section is located outside of said housing;

a supply of ink retained within said fluid absorbent member; and an elongate pressure-exerting member movably positioned within said port in said side wall portion of said housing, said pressure-exerting member comprising an inner end and an outer end, said inner end being located within said internal cavity of said housing and said outer end being located outside of said housing, said pressure exerting member further comprising an elongate bore passing entirely therethrough from said outer end to said inner end, whereby movement of said pressure-exerting member inwardly by applying pressure against said outer end of said pressure-exerting member causes said inner end thereof to press against said fluid absorbent member within said internal cavity of said housing and also causes air to enter into said internal cavity from said bore.

3. A refill unit designed for insertion within an empty ink cartridge unit comprising:

a housing sized for placement within said empty ink cartridge unit, said housing comprising an upper portion, a lower portion, a side wall portion between said upper portion and said lower portion which comprises at least one port therethrough, and an internal cavity within said housing and surrounded by said side wall portion, said lower portion comprising a lower panel member which comprises an exterior surface and at least one opening through said lower panel member in order to provide access to said internal cavity within said housing;

a fluid absorbent member positioned within said internal cavity of said housing, said fluid absorbent member comprising a lower section extending outwardly from said opening in said lower panel member and beyond said exterior surface of said lower panel member so that said lower section is located outside of said housing;

a supply of ink retained within said fluid absorbent member; and an elongate pressure-exerting member movably positioned within said port in said side wall portion of said housing, said pressure-exerting member comprising an inner end and an outer end, said inner end being located within said internal cavity of said housing and said outer end being located outside of said housing, said pressure exerting member further comprising an elongate bore passing entirely therethrough from said outer end to said inner end, whereby movement of said pressure-exerting member inwardly by applying pressure against said outer end of said pressure-exerting member causes said inner end thereof to press against said fluid absorbent member within said internal cavity of said housing and also causes air to enter into said internal cavity from said bore.

4. An ink cartridge printing assembly comprising:

an ink cartridge unit comprising:

a containment vessel comprising an open top portion, a bottom portion, and a retaining wall portion between said open top portion and said bottom portion, said containment vessel further comprising an internal chamber positioned within said containment vessel and surrounded by said retaining wall portion, said bottom portion further comprising a printhead for expelling ink from said containment vessel;

a tubular conduit positioned within said cartridge unit between said printhead and said internal chamber, said conduit comprising an upper end and a lower end, said lower end being positioned adjacent to and in fluid communication with said printhead, with said upper end being positioned adjacent to and in fluid communication with said internal chamber within said containment vessel;

a filter member secured to and covering said upper end of said conduit; and an annular seal member fixedly secured to said filter member and positioned directly over said upper end of said conduit; and a refill unit positioned within said containment vessel of said ink cartridge unit comprising:

a housing located within said internal chamber of said ink cartridge unit, said housing comprising an upper portion, a lower portion, a side wall portion between said upper portion and said lower portion, and an internal cavity within said housing and surrounded by said side wall portion, said lower portion comprising a lower panel member which comprises at least one opening therethrough in order to provide access to said internal cavity within said housing, said lower panel member further comprising an exterior surface and a continuous annular channel separate from said opening, said annular channel being positioned within said exterior surface of said lower panel member and spaced outwardly from said opening, said annular channel entirely surrounding said opening through said lower panel member, said annular seal member of said cartridge unit being positioned within said annular channel of said refill unit in order to provide a fluid-tight seal and proper alignment between said refill unit and said cartridge unit;

a fluid absorbent member positioned within said internal cavity of said housing, said fluid absorbent member comprising a lower section extending outwardly from said opening in said lower panel member and beyond said exterior surface of said lower panel member so that said lower section is located outside of said housing, said lower section of said fluid absorbent member being positioned against and in contact with said filter member of said cartridge unit, with said lower section of said fluid absorbent member being surrounded by said annular seal member of said cartridge unit; and a supply of ink retained within said fluid absorbent member.

5. An ink cartridge printing assembly comprising:

an ink cartridge unit comprising:

a containment vessel comprising an open top portion, a bottom portion, and a retaining wall portion between said open top portion and said bottom portion, said containment vessel further comprising an internal chamber positioned within said containment vessel and surrounded by said retaining wall portion, said bottom portion further comprising a printhead for expelling ink from said containment vessel;

a tubular conduit positioned within said cartridge unit between said printhead and said internal chamber, said conduit comprising an upper end and a lower end, said lower end being positioned adjacent to and in fluid communication with said printhead, with said upper end being positioned adjacent to and in fluid communication with said internal chamber within said containment vessel; and a filter member secured to and covering said upper end of said conduit; and a refill unit positioned within said containment vessel of said ink cartridge unit comprising:

a housing located within said internal chamber of said ink cartridge unit, said housing comprising an upper portion, a lower portion, a side wall portion between said upper portion and said lower portion, and an internal gravity within said housing and surrounded by said side wall portion, said lower portion comprising a lower panel member which comprises an exterior surface and at least one opening through said lower panel member in order to provide access to said internal cavity within said housing;

a fluid absorbent member positioned within said internal cavity of said housing, said fluid absorbent member comprising a lower section extending outwardly from said opening in said lower panel member and beyond said exterior surface of said lower panel member so that said lower section is located outside of said housing, said lower section of said fluid absorbent member being positioned against and in contact with said filter member of said cartridge unit, with said lower panel member of said housing being positioned above and spaced apart from said filter member of said cartridge unit; and a supply of ink retained within said fluid absorbent member.

6. An ink cartridge printing assembly comprising:

an ink cartridge unit comprising:

a containment vessel comprising an open top portion, a bottom portion, and a retaining wall portion between said open top portion and said bottom portion, said containment vessel further comprising an internal chamber positioned within said containment vessel and surrounded by said retaining wall portion, said bottom portion further comprising a printhead for expelling ink from said containment vessel;

a tubular conduit positioned within said cartridge unit between said printhead and said internal chamber, said conduit comprising an upper end and a lower end, said lower end being positioned adjacent to and in fluid communication with said printhead, with said upper end being positioned adjacent to and in fluid communication with said internal chamber within said containment vessel;

a filter member secured to and covering said upper end of said conduit, said filter member comprising at least one outer edge; and at least one ink drainage compartment positioned within said bottom portion of said cartridge unit adjacent said conduit; and a refill unit positioned within said containment vessel of said ink cartridge unit comprising:

a housing located within said internal chamber of said ink cartridge unit, said housing comprising an upper portion, a lower portion, a side wall portion between said upper portion and said lower portion, and an internal cavity within said housing and surrounded by said side wall portion, said lower portion comprising a lower panel member which comprises an exterior surface and at least one opening through said lower panel member in order to provide access to said internal cavity within said housing;

a fluid absorbent member positioned within said internal cavity of said housing, said fluid absorbent member comprising a lower section extending outwardly from said opening in said lower panel member and beyond said exterior surface of said lower panel member so that said lower section is located outside of said housing, said lower section of said fluid absorbent member being positioned against and in contact with said filter member of said ink cartridge unit, said lower section of said fluid absorbent member further comprising at least one outwardly-extending end portion, said end portion extending beyond said outer edge of said filter member and being positioned at least partially within said ink drainage compartment so that residual ink materials retained therein are withdrawn into said fluid absorbent member; and a supply of ink retained within said fluid absorbent member.

7. The ink cartridge printing assembly of claim 6 wherein said side wall portion of said refill unit comprises at least one port therethrough and an elongate pressure-exerting member movably positioned within said port, said pressure-exerting member comprising an inner end and an outer end, said inner end being located within said internal cavity of said housing and said outer end being located outside of said housing, said pressure exerting member further comprising an elongate bore passing entirely therethrough from said outer end to said inner end, whereby movement of said pressure-exerting member inwardly by applying pressure against said outer end of said pressure-exerting member causes said inner end thereof to press against said fluid absorbent member within said internal cavity of said housing and also causes air to enter into said internal cavity from said bore.

8. A method for refilling an empty ink cartridge unit with ink comprising the steps of:

providing an empty ink cartridge unit comprising:

a containment vessel comprising an open top portion, a bottom portion, and a retaining wall portion between said open top portion and said bottom portion, said containment vessel further comprising an internal chamber positioned within said containment vessel and surrounded by said retaining wall portion, said bottom portion further comprising a printhead for expelling ink from said containment vessel;

a tubular conduit positioned within said cartridge unit between said printhead and said internal chamber, said conduit comprising an upper end and a lower end, said lower end being positioned adjacent to and in fluid communication with said printhead, with said upper end being positioned adjacent to and in fluid communication with said internal chamber within said containment vessel;

a filter member secured to and covering said upper end of said conduit; and an annular seal member fixedly secured to said filter member and positioned directly over said upper end of said conduit;

inserting a refill unit within said internal chamber of said ink cartridge unit, said refill unit comprising:

a housing comprising an upper portion, a lower portion, a side wall portion between said upper portion and said lower portion, and an internal cavity within said housing and surrounded by said side wall portion, said lower portion comprising a lower panel member which comprises at least one opening therethrough in order to provide access to said internal cavity within said housing, said lower panel member further comprising an exterior surface and a continuous annular channel separate from said opening, said annular channel being positioned within said exterior surface of said lower panel member and spaced outwardly from said opening, said annular channel entirely surrounding said opening through said lower panel member;

a fluid absorbent member positioned within said internal cavity of said housing, said fluid absorbent member comprising a lower section extending outwardly from said opening in said lower panel member and beyond said exterior surface of said lower panel member so that said lower section is located outside of said housing; and a supply of ink retained within said fluid absorbent member; and urging said refill unit downwardly within said internal chamber of said ink cartridge unit until said annular seal member of said cartridge unit is positioned within said annular channel of said refill unit in order to provide a fluid-tight seal and proper alignment between said refill unit and said cartridge unit and to place said lower section of said fluid absorbent member against and in contact with said filter member in said cartridge unit, with said lower section of said fluid absorbent member being surrounded by said annular seal member of said cartridge unit.

9. A method for refilling an empty ink cartridge unit comprising the steps of:

providing an empty ink cartridge unit comprising:

a containment vessel comprising an open top portion, a bottom portion, and a retaining wall portion between said open top portion and said bottom portion, said containment vessel further comprising an internal chamber positioned within said containment vessel and surrounded by said retaining wall portion, said bottom portion further comprising a printhead for expelling ink from said containment vessel;

a tubular conduit positioned within said cartridge unit between said printhead and said internal chamber, said conduit comprising an upper end and a lower end, said lower end being positioned adjacent to and in fluid communication with said printhead, with said upper end being positioned adjacent to and in fluid communication with said internal chamber within said containment vessel; and a filter member secured to and covering said upper end of said conduit;

inserting a refill unit within said internal chamber of said ink cartridge unit, said refill unit comprising:

a housing comprising an upper portion, a lower portion, a side wall portion between said upper portion and said lower portion, and an internal cavity within said housing and surrounded by said side wall portion, said lower portion comprising a lower panel member which comprises an exterior surface and at least one opening through said lower panel member in order to provide access to said internal cavity within said housing;

a fluid absorbent member positioned within said internal cavity of said housing, said fluid absorbent member comprising a lower section extending outwardly from said opening in said lower panel member and beyond said exterior surface of said lower panel member so that said lower section is located outside of said housing; and a supply of ink retained within said fluid absorbent member; and urging said refill unit downwardly within said internal chamber of said cartridge unit until said lower section of said fluid absorbent member is positioned against and in contact with said filter member in said cartridge unit, with said lower panel member of said housing being positioned above and spaced apart from said filter member of said cartridge unit.

10. A method for refilling an empty ink cartridge unit comprising the steps of:

providing an empty ink cartridge unit comprising:

a containment vessel comprising an open top portion, a bottom portion, and a retaining wall portion between said open top portion and said bottom portion, said containment vessel further comprising an internal chamber positioned within said containment vessel and surrounded by said retaining wall portion, said bottom portion further comprising a printhead for expelling ink from said containment vessel;

a tubular conduit positioned within said cartridge unit between said printhead and said internal chamber, said conduit comprising an upper end and a lower end, said lower end being positioned adjacent to and in fluid communication with said printhead, with said upper end being positioned adjacent to and in fluid communication with said internal chamber within said containment vessel;

a filter member secured to and covering said upper end of said conduit, said filter member comprising at least one outer edge; and at least one ink drainage compartment positioned within said bottom portion of said cartridge unit adjacent said conduit;

inserting a refill unit within said internal chamber of said ink cartridge unit, said refill unit comprising:

a housing comprising an upper portion, a lower portion, a side wall portion between said upper portion and said lower portion, and an internal cavity within said housing and surrounded by said side wall portion, said lower portion comprising a lower panel member which comprises an exterior surface and at least one opening through said lower panel member in order to provide access to said internal cavity within said housing;

a fluid absorbent member positioned within said internal cavity of said housing, said fluid absorbent member comprising a lower section extending outwardly from said opening in said lower panel member and beyond said exterior surface of said lower panel member so that said lower section is located outside of said housing, said lower section of said fluid absorbent member further comprising at least one outwardly-extending end portion; and a supply of ink retained within said fluid absorbent member; and urging said refill unit downwardly within said internal chamber of said ink cartridge unit so that said lower section of said fluid absorbent member is positioned against and in contact with said filter member of said cartridge unit and said outwardly extending end portion of said lower section extends beyond said outer edge of said filter member, said end portion being positioned at least partially within said ink drainage compartment so that residual ink materials retained therein are withdrawn into said fluid absorbent member.

11. An ink cartridge unit comprising:

a containment vessel comprising an open top portion, a bottom portion, and a retaining wall portion between said open top portion and said bottom portion, said containment vessel further comprising an internal chamber positioned within said containment vessel and surrounded by said retaining wall portion, said bottom portion further comprising a printhead for expelling ink from said containment vessel;

a tubular conduit positioned within said cartridge unit between said printhead and said internal chamber, said conduit comprising an upper end and a lower end, said lower end being positioned adjacent to and in fluid communication with said printhead, with said upper end being positioned adjacent to and in fluid communication with said internal chamber within said containment vessel;

a filter member secured to and covering said upper end of said conduit; and an annular seal member fixedly secured to said filter member and positioned directly over said filter member and said upper end of said conduit.

12. An ink cartridge printing assembly comprising:

an ink cartridge unit comprising:

a containment vessel comprising an open top portion, a bottom portion, and a retaining wall portion between said open top portion and said bottom portion, said containment vessel further comprising an internal chamber positioned within said containment vessel and surrounded by said retaining wall portion, said bottom portion further comprising a printhead for expelling ink from said containment vessel;

a tubular conduit positioned within said cartridge unit between said printhead and said internal chamber, said conduit comprising an upper end and a lower end, said lower end being positioned adjacent to and in fluid communication with said printhead, with said upper end being positioned adjacent to and in fluid communication with said internal chamber within said containment vessel;

a filter member secured to and covering said upper end of said conduit; and an annular seal member fixedly secured to said filter member and positioned directly over said upper end of said conduit; and a refill unit positioned within said containment vessel of said ink cartridge unit comprising:

a housing located within said internal chamber of said ink cartridge unit, said housing comprising an upper portion, a lower portion, a side wall portion between said upper portion and said lower portion which comprises at least one port therethrough, and an internal cavity within said housing and surrounded by said side wall portion, said lower portion comprising a lower panel member which comprises at least one opening therethrough in order to provide access to said internal cavity within said housing, said lower panel member further comprising an exterior surface and a continuous annular channel separate from said opening, said annular channel being positioned within said exterior surface of said lower panel member and spaced outwardly from said opening, said annular channel entirely surrounding said opening through said lower panel member, said annular seal member of said cartridge unit being positioned within said annular channel of said refill unit in order to provide a fluid-tight seal and proper alignment between said refill unit and said cartridge unit;

a fluid absorbent member positioned within said internal cavity of said housing, said fluid absorbent member comprising a lower section extending outwardly from said opening in said lower panel member and beyond said exterior surface of said lower panel member so that said lower section is located outside of said housing, said lower section of said fluid absorbent member being positioned against and in contact with said filter member of said cartridge unit, with said lower section of said fluid absorbent member being surrounded by said annular seal member of said cartridge unit;

a supply of ink retained within said fluid absorbent member; and an elongate pressure-exerting member movably positioned within said port through said side wall portion of said housing, said pressure-exerting member comprising an inner end and an outer end, said inner end being located within said internal cavity of said housing and said outer end being located outside of said housing, said pressure exerting member further comprising an elongate bore passing entirely therethrough from said outer end to said inner end, whereby movement of said pressure-exerting member inwardly by applying pressure against said outer end of said pressure-exerting member causes said inner end thereof to press against said fluid absorbent member within said internal cavity of said housing and also causes air to enter into said internal cavity from said bore.

13. An ink cartridge printing assembly comprising:

an ink cartridge unit comprising:

a containment vessel comprising an open top portion, a bottom portion, and a retaining wall portion between said open top portion and said bottom portion, said containment vessel further comprising an internal chamber positioned within said containment vessel and surrounded by said retaining wall portion, said bottom portion further comprising a printhead for expelling ink from said containment vessel;

a tubular conduit positioned within said cartridge unit between said printhead and said internal chamber, said conduit comprising an upper end and a lower end, said lower end being positioned adjacent to and in fluid communication with said printhead, with said upper end being positioned adjacent to and in fluid communication with said internal chamber within said containment vessel; and a filter member secured to and covering said upper end of said conduit; and a refill unit positioned within said containment vessel of said ink cartridge unit comprising:

a housing located within said internal chamber of said ink cartridge unit, said housing comprising an upper portion, a lower portion, a side wall portion between said upper portion and said lower portion which comprises at least one port therethrough, and an internal cavity within said housing and surrounded by said side wall portion, said lower portion comprising a lower panel member which comprises an exterior surface and at least one opening through said lower panel member in order to provide access to said internal cavity within said housing;

a fluid absorbent member positioned within said internal cavity of said housing, said fluid absorbent member comprising a lower section extending outwardly from said opening in said lower panel member and beyond said exterior surface of said lower panel member so that said lower section is located outside of said housing, said lower section of said fluid absorbent member being positioned against and in contact with said filter member of said cartridge unit, with said lower panel member of said housing being positioned above and spaced apart from said filter member of said cartridge unit;

a supply of ink retained within said fluid absorbent member; and an elongate pressure-exerting member movably positioned within said port through said side wall portion of said housing, said pressure-exerting member comprising an inner end and an outer end, said inner end being located within said internal cavity of said housing and said outer end being located outside of said housing, said pressure exerting member further comprising an elongate bore passing entirely therethrough from said outer end to said inner end, whereby movement of said pressure-exerting member inwardly by applying pressure against said outer end of said pressure-exerting member causes said inner end thereof to press against said fluid absorbent member within said internal cavity of said housing and also causes air to enter into said internal cavity from said bore.

* * * * *

UNITED STATES PATENT AND TRADEMARK OFFICE

CERTIFICATE OF CORRECTION

PATENT NO. : 5,680,164
DATED : October 21, 1997
INVENTOR(S) : Miller et al.

It is certified that error appears in the above-identified patent and that said Letters Patent is hereby corrected as shown below:

Column 26,
Line 57, delete “gravity” and insert therefor -- cavity --.

Signed and Sealed this

Ninth Day of September, 2003

JAMES E. ROGAN
*Director of the United States Patent and Trademark Office*